US005472525A

United States Patent [19]

Tokunaga et al.

[11] Patent Number: 5,472,525

[45] Date of Patent: Dec. 5, 1995

[54] ND-FE-B SYSTEM PERMANENT MAGNET

[75] Inventors: Masaaki Tokunaga, Fukaya; Shigeho Tanigawa, Kounosu; Masahiro Takahashi, Kumagaya, all of Japan

[73] Assignee: Hitachi Metals., Ltd., Tokyo, Japan

[21] Appl. No.: 217,091

[22] Filed: Jan. 28, 1994

[30] Foreign Application Priority Data

| | | | |
|---|---|---|---|
| Jan. 29, 1993 | [JP] | Japan | 5-013083 |
| Mar. 17, 1993 | [JP] | Japan | 5-082563 |
| Mar. 17, 1993 | [JP] | Japan | 5-082564 |
| Mar. 17, 1993 | [JP] | Japan | 5-082565 |

[51] Int. Cl.[6] ..... H01F 1/057

[52] U.S. Cl. ..... 148/302; 420/83; 420/121; 75/244

[58] Field of Search ..... 148/302; 420/83, 420/121; 75/244

[56] References Cited

U.S. PATENT DOCUMENTS

| | | | |
|---|---|---|---|
| 4,859,254 | 8/1989 | Mizoguchi et al. | 148/302 |
| 4,935,075 | 6/1990 | Mizoguchi et al. | 148/302 |
| 5,223,047 | 6/1993 | Endoh et al. | 148/302 |
| 5,230,751 | 7/1993 | Endoh et al. | 148/302 |

FOREIGN PATENT DOCUMENTS

| | | | |
|---|---|---|---|
| 0258609 | 3/1988 | European Pat. Off. | 148/302 |
| 63-453 | 1/1988 | Japan | 148/101 |

*Primary Examiner*—John Sheehan

*Attorney, Agent, or Firm*—Sughrue, Mion, Zinn, Macpeak & Seas

[57] ABSTRACT

Disclosed is a Nd-Fe-B system magnet having coercive force iHc of 12 KOe or more and high maximum energy product (BH)max of 42 MGOe or more.

The permanent magnet consists of 28 to 32 wt. % of Nd and Dy (Dy ranges from 0.4 to 3 wt. %), 6 wt. % or less of Co, 0.5 wt. % or less of Al, 0.9 to 1.3 wt. % of B, at least one of 0.05 to 2.0 wt. % of Nb and 0.05 to 2.0 wt. % of V, 0.02 to 0.5 wt. % of Ga, Fe and unavoidable impurities, having coercive force iHc of 12 KOe or more and maximum energy product (BH)max of 42 MGOe or more.

15 Claims, 20 Drawing Sheets

ND-FE-B SYSTEM PERMANENT MAGNET

FIELD OF THE INVENTION

This invention relates to a permanent magnet comprising chiefly neodymium (Nd), iron (Fe), cobalt (Co) and boron (B), an Nd-Fe-B system sintered permanent magnet having a superior energy product and heat resistance.

BACKGROUND OF THE INVENTION

The Nd-Fe-B system sintered magnet has a higher maximum energy product (BH)max compared with $SmCo_5$ system sintered magnets or $Sm_2Co_{17}$ system sintered magnets and is used for various purposes. However, since the Nd-Fe-B system sintered magnet has less thermal stability than Sm-Co system sintered magnets, various trials have been proposed to improve its thermal stability.

Japanese Patent Application Laid-open Print No. 7503/1989 describes a permanent magnet having superior thermal stability which are represented by the following general formulas:

$$R(Fe_{1-x-y-z}Co_xB_yGa_z)_A$$

(R is at least one element selected from rare earth elements. $0 \leqq x \leqq 0.7$, $0.02 \leqq y \leqq 0.3$, $0.001 \leqq z \leqq 0.15$ and $4.0 \leqq A \leqq 7.5$), and $$R(Fe_{1-x-y-z}Co_xB_yGa_zM_u)_A$$

(R is at least one element selected from rare earth elements, M is at least one element selected from Nb, W, V, Ta and Mo. $0 \leqq x \leqq 0.7$, $0.02 \leqq y \leqq 0.3$, $0.001 \leqq z \leqq 0.15$, $u \leqq 0.1$ and $4.0 \leqq A \leqq 7.5$).

By adding Ga, this permanent magnet has realized superior thermal stability with an improved coercive force iHc.

Recently, devices using permanent magnets have been further miniaturized and, accordingly, a permanent magnet having both excellent thermal stability and a higher energy product has been desired. The aforementioned permanent magnet is superior in thermal stability but cannot meet the energy product requirement. Permanent magnets are practically required to have coercive forces iHc of 12 KOe or more but permanent magnets providing a coercive force of this level have maximum energy products (BH)max of only 40 MGOe or below.

SUMMARY OF THE INVENTION

This invention is to provide an Nd-Fe-B system magnet suitable for practical use that has a coercive force iHc of 12 KOe or more and a high maximum energy product (BH)max of 42 MGOe or more.

The permanent magnet of this invention includes an Nd-Fe-B system magnet consisting of 28 to 32 wt. % of Nd and Dy (Dy ranges from 0.4 to 3 wt. %), 6 wt. % or less of Co, 0.5 wt. % or less of Al, 0.9 to 1.3 wt. % of B, at least one of 0.05 to 2.0 wt. % of Nb and 0.05 to 2.0 wt. % of V, 0.02 to 0.5 wt. % of Ga, Fe and unavoidable impurities, having a coercive force iHc of 12 KOe or more and a maximum energy product (BH)max of 42 MGOe or more.

The permanent magnet of this invention further includes an Nd-Fe-B system permanent magnet consisting of 28 to 32 wt. % of Nd and Dy (Dy ranges from 0.4 to 3 wt. %), 0.3 wt. % or less of Al, 0.9 to 1.3 wt. % of B, one or two elements of 0.05 to 2.0 wt. % of Nb and 0.05 to 2.0 wt. % of V, 0.02 to 0.5 wt. % of Ga, Fe and unavoidable impurities, having a coercive force iHc of 12 KOe or more and a maximum energy product (BH)max of 42 MGOe or more.

DETAILED DESCRIPTION OF THE INVENTION

Figure 1A:
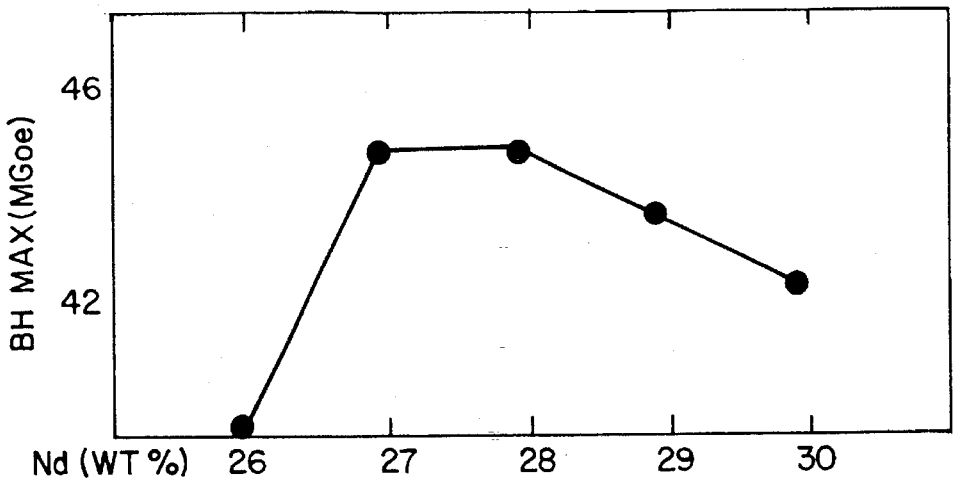
FIG. 1 is a graph showing the relation among Nd content, maximum energy product (BH)max, residual magnetic flux density Br and coercive force iHc of a Nd-Fe-Co-B system sintered magnet.

The permanent magnet of this invention consists of 28 to 32 wt. % of Nd and Dy (Dy ranges from 0.4 to 3 wt. %), 6 wt. % or less of Co, 0.5 wt. % or less of Al, 0.9 to 1.3 wt. % of B, at least one of 0.05 to 2.0 wt. % of Nb and 0.05 to 2.0 wt. % of V, 0.02 to 0.5 wt. % of Ga, Fe and unavoidable impurities, having excellent properties such as coercive force iHc of 12 KOe or more and maximum energy product (BH)max of 42 MGOe or more.

Further, the permanent magnet of this invention consists of 28 to 32 wt. % of Nd and Dy (Dy ranges from 0.4 to 3 wt. %), 0.3 wt. % or less of Al, 0.9 to 1.3 wt. % of B, one or two elements of 0.05 to 2.0 wt. % of Nb and 0.05 to 2.0 wt. % of V, 0.02 to 0.5 wt. % of Ga, Fe and unavoidable impurities, and has properties such as coercive force iHc of 12 KOe or more and maximum energy product (BH)max of 42 MGOe or more.

The magnet of this invention was attained based on the following knowledge obtained by detailed examination of the composition of Nd-Fe-B system magnets.

(1) Maximum energy product (BH)max is increased by lowering Nd content but adversely coercive force iHc is lowered.

(2) It is effective to add Ga to supplement the lowering of coercive force iHc due to the decrease of Nd content, but this effect of improving coercive force iHc by Ga addition reaches saturation when Ga is added up to a certain level and the lowering of coercive force iHc cannot be fully supplemented.

(3) Dy is effective to improve coercive force iHc which cannot be supplemented by the addition of Ga. By adding Dy in an amount which does not lower residual magnetic flux density Br so much, there can be obtained an Nd-Fe-B system magnet having high maximum energy product (BH)max of 42 MGOe or more and coercive force iHc of 12 KOe or more.

Reasons of limiting the compositions of the magnets of this invention will be described below.

Nd and Dy

Nd and Dy are contained in a range of 28 to 32 wt. % (Dy ranges from 0.4 to 3 wt. %).

The less the Nd content is, the more effectively the maximum energy product (BH)max and residual magnetic flux density Br are improved, but at the same time, the coercive force iHc is lowered. Dy is added to improve the coercive force iHc. Dy is effective to raise the Curie point Tc and increase the anisotropic magnetic field ($H_A$) as well so that contribute for the improvement of coercive force iHc. But an excessive content of Dy causes both the residual magnetic flux density Br and the maximum energy product (BH)max to be lowered. Therefore, the content of Dy is determined to be in a range of 0.4 to 3.0 wt. %. And the most desirable content of Dy is in a range of 0.7 to 1.5 wt. %.

When the Nd content is lowered, α-Fe is generated in an ingot and the increase of maximum energy product (BH)max is hardly expected. When the Nd content is increased, on the other hand, the Nd rich phase is increased and the maximum energy product (BH)max is lowered. In view of this, a total content of Nd and Dy is determined to be in a range of 28 to 32 wt. %. Portion of Nd can be substituted by Pr and other rare earth elements excluding Dy.

Co

Co has effects of improving corrosion resistance of a magnetic alloy substantially without lowering the residual magnetic flux density Br and of further increasing corrosion resistance by improving the adhesion of Ni plating to the magnet alloy. And it also has an effect of increasing the Curie point Tc as Fe in a main phase ($Nd_2Fe_{14}B$) is substituted by Co. But, when the amount of substitution by Co increases, a coarse crystal grain is formed due to the unusual grain growth in the sintering process, resulting in lowering the coercive force iHc in causing the and squareness of hysteresis curve. Therefore, Co is added 6.0 wt. % or less.

Al

Al has an effect of moderating temperature condition in the heat-treating process for Co-added materials. The magnetic characteristic of the materials containing Co is largely affected by the changes in heat-treating temperature. But, when an appropriate amount of Al is added to the materials, the magnetic characteristic does not change even when the heat-treating temperature is fluctuated to some extent. Thus, the production process can be easily controlled and permanent magnets with stable quality can be produced efficiently.

When the Al content exceeds 0.5 wt. %, the decrease of residual magnetic flux density Br becomes obvious. Therefore, the Al content is determined to be 0.5 wt. % or below. When Co is not added, the Al content is determined to be 0.3 wt. % or below to avoid residual magnetic flux density is further lowered.

B

When B is less than 0.9 wt. %, a high coercive force can not be obtained. On the contrary, when it exceeds 1.3 wt. %, a non-magnetic phase rich in B is increased and residual magnetic flux density Br is lowered. Therefore, the B content is determined to be in a range of 0.9 to 1.3 wt. %, and more preferably in a range of 0.95 to 1.1 wt. %.

Ga

Ga has an effect of substantially improving the coercive force iHc without lowering the residual magnetic flux density Br. When the Ga content is less than 0.02 wt. %, coercive force iHc is not sufficiently improved, and when exceeding 0.5 wt. %, the coercive force improvement is saturated and residual magnetic flux density Br is lowered. Therefore, the Ga content is determined to be in a range of 0.02 to 0.5 wt. %, and more preferably in a range of 0.03 to 0.2 wt. %, and most preferably in a range of 0.05 to 0.15 wt. %.

Ga exhibits its effects by being contained in an Nd phase which is rich in Nd within a magnet body. And, its effects are particularly remarkable when the Ga content in the Nd phase is two times or more of the total added amount of Ga.

Nb and V

The permanent magnets of this invention contain one or two elements of Nb and V in 0.05 to 2.0 wt. %, respectively. Nb and V have all effect of suppressing the crystal grain from becoming coarse at the sintering process resulting in an increase in coercive force iHc and an improvement in the squareness of a hysteresis curve. In addition, when the crystal grain of a sintered body is made fine, magnetic deposition is improved, and a Nd-Fe-B system magnet having good magnetic deposition has excellent heat resistance. That is to say, Nb and V are effective to improve heat resistance. When at least one of the Nb and V content is less than 0.05 wt. %, their effect to suppress coarse crystal grain is insufficient. When the content exceeds 2.0 wt %, non-magnetic boride of Nb and V or Nb-Fe and V-Fe is generated in a large amount, and residual magnetic flux density Br and Curie point Tc are unfavorably markedly lowered. Therefore, the Nb and V contents are determined to be in a range of 0.05 to 2.0 wt. %, respectively, and more preferably in a range of 0.1 to 1.0 wt. %.

Oxygen

Oxygen content is desirably determined to be 500 ppm to 5000 ppm. When oxygen is less than 500 ppm, the magnet powder and its compact body are Inflammable, leading to danger in the production process. On the other hand, when oxygen exceeds 5000 ppm, oxide in conjunction with Nd and Dy is produced so that the contents of Nd and Dy which effectively act on magnetism are reduced causing it to become difficult to obtain a magnet having high coercive force and energy product.

The sintered magnet of this invention can be produced by the following process. An ingot having a certain composition is produced by melting in a vacuum and crushed into coarse powder having a particle diameter of about 500 micrometers. Then, the coarse powder is finely ground by means of a Jet mill in an inert gas atmosphere to obtain fine powder having an average grain diameter of 3.0 to 6.0 micrometers (F.S.S.S.). The fine powder is press-molded in the magnetic field under conditions that an orientational magnetic field is 15 KOe and a molding pressure is 1.5 tons/cm$^2$, and sintered at a temperature in a range of 1000 to 1150° C.

The obtained sintered body is cooled down to room temperature. The cooling rate after sintering does not substantially effect the final product. Then, the sintered body is heat-treated up to a temperature of 800° to 1000° C. and held at that temperature for 0.2 to 5 hours. This process is determined to be a primary heat treatment. When the heating temperature is less than 800° C. or exceeds 1000° C., a sufficiently high coercive force cannot be obtained. After the above heating and holding, the sintered body is cooled down to room temperature or 600° C. at a cooling rate of 0.3 to 50° C./min. When the cooling rate exceeds 50° C./min, a required balanced phase cannot be obtained because of aging, so that a sufficiently high coercive force cannot be obtained. When the cooling rate is less than 0.3° C./min, the heat treatment takes time, resulting in uneconomical in view of industrial production. The cooling rate is preferably 0.6 to 2.0° C./min. The cooling is desirably completed at room temperature but is allowed to be up to 600° C. and quenched thereafter at the cost of coercive force iHc to some extent. The sintered body is preferably cooled down to a temperature in a range of room temperature to 400° C.

The heat treatment is further conducted at a temperature in a range of 500° to 650° C. for 0.2 to 3 hours. This step is defined as a secondary heat treatment. Though desirable temperature is variable depending on compositions, the heat treatment is effective at 540° to 640° C. When the heat treatment temperature is less than 500° C. or higher than 650° C., an irreversible demagnetizing factor is lowered even if a high coercive force is obtained. After the heat treatment, the sintered body is cooled at a cooling rate of 0.3 to 400° C./min in the same way as the primary heat treatment. The cooling can be made in water, silicone oil, argon current, etc. When the cooling rate exceeds 400° C./min, quenching causes cracks in a magnet, and a permanent magnet material which is industrially variable cannot be obtained. When the cooling rate is less than 0.3° C./min, on the other hand, a phase which is unfavorable for coercive force iHc appears in the process of cooling.

The invention is now illustrated in greater detail with reference to the following specific examples and embodiments, but the present invention is not to be construed as being limited thereto.

EXAMPLE 1

Metallic Nd, metallic Dy, Fe, Co, ferro-B, ferro-Nb and metallic Ga were prepared in a certain weight and melted in a vacuum to produce a 10-kg ingot. This ingot had the following composition in weight %.

Composition:

$$Nd_a\text{-}Dy_b\text{-}B_{1.05}\text{-}V_{0.58}\text{-}Ga_c\text{-}Co_{0.20}\text{-}Al_{0.33}\text{-}Fe_{balance}$$

This ingot was crushed with a hammer and further crushed by means of a coarse crusher in an atmosphere of inert gas to obtain coarse powder having a particle diameter of 500 micrometers or below. This coarse powder was finely ground using a jet mill in an atmosphere of inert gas to obtain fine powder having an average grain diameter of 4.0 micrometers (F.S.S.S.) and oxygen content of 5400 ppm. The fine powder was then press-molded in the magnetic field under conditions that an orientational magnetic field strength was 15 KOe and a molding pressure was 1.5 tons/cm$^2$ to prepare a compact of 20×20×15 (mm). The compact was sintered at 1080° C. for three hours under a condition of substantially vacuum. The obtained sintered body was subjected to the primary heat treatment at 900° C. for two hours, then to the secondary heat treatment at 530° C. for two hours. The resulting sintered body had a density of 7.55 to 7.58 g/cc and oxygen content of 1000 to 4000 ppm.

Figure 1B:
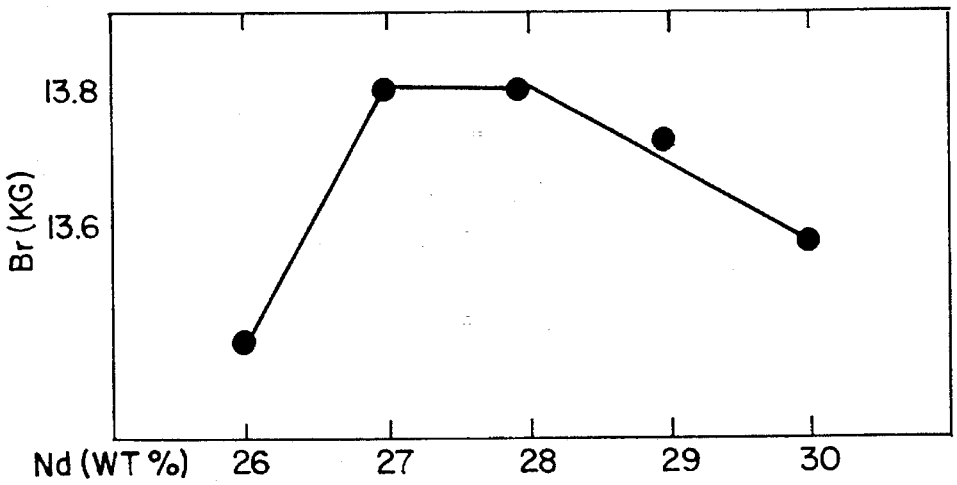
Figure 1C:
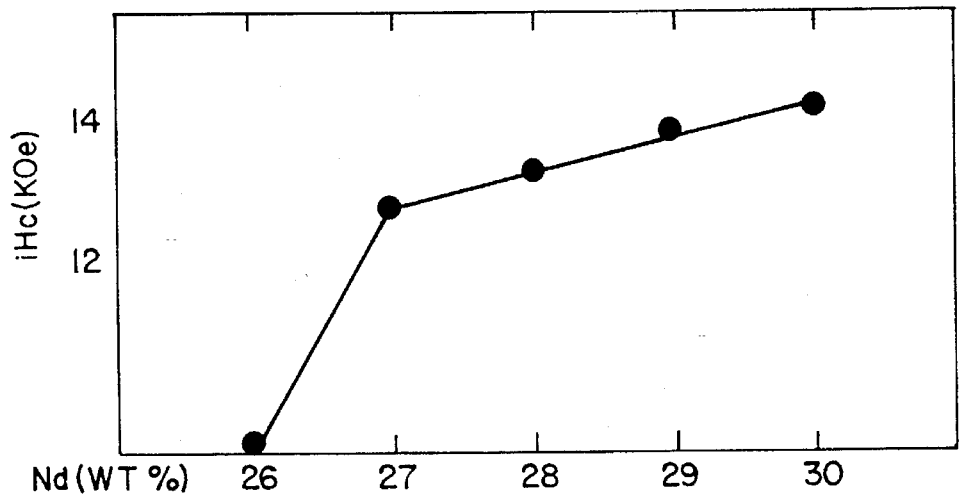
Figure 2A:
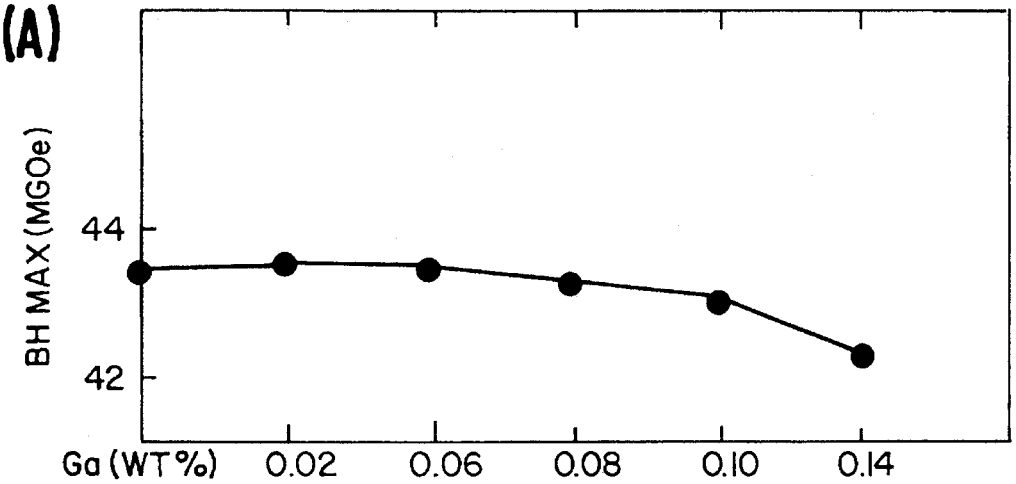
FIG. 2 is a graph showing the relation among Ga content, maximum energy product (BH)max, residual magnetic flux density Br and coercive force iHc of a Nd-Fe-Co-B system sintered magnet.
Figure 2B:
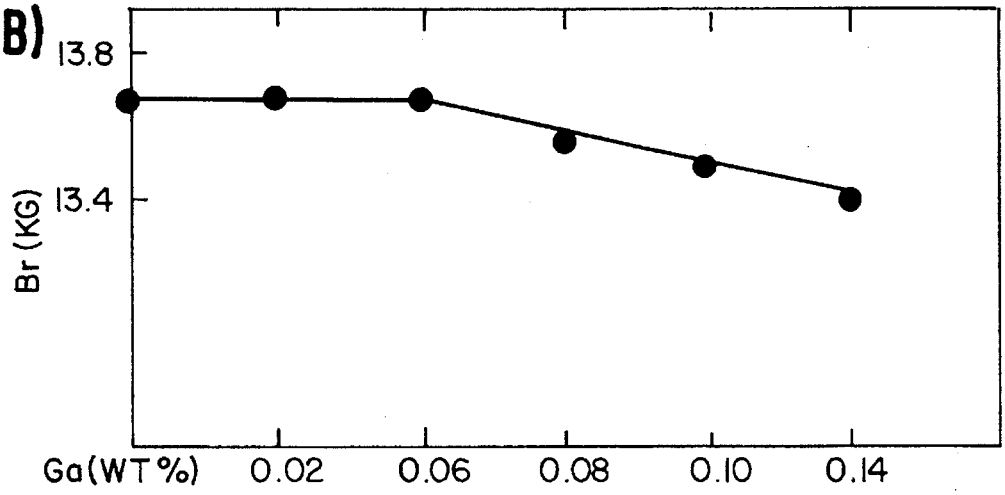
Figure 2C:
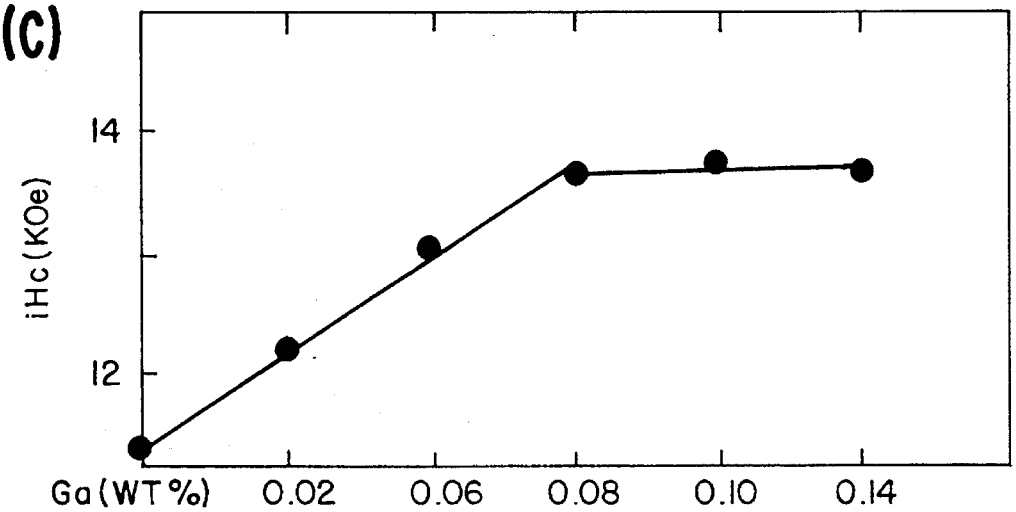
Figure 3A:
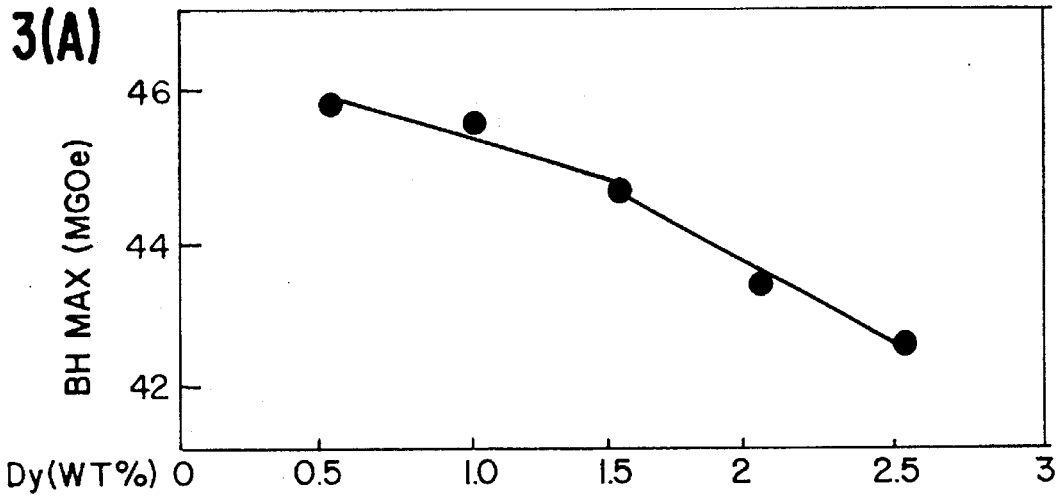
FIG. 3 is a graph showing the relation among Dy content, maximum energy product (BH)max, residual magnetic flux density Br and coercive force iHc of a Nd-Fe-Co-B system sintered magnet.
Figure 3B:
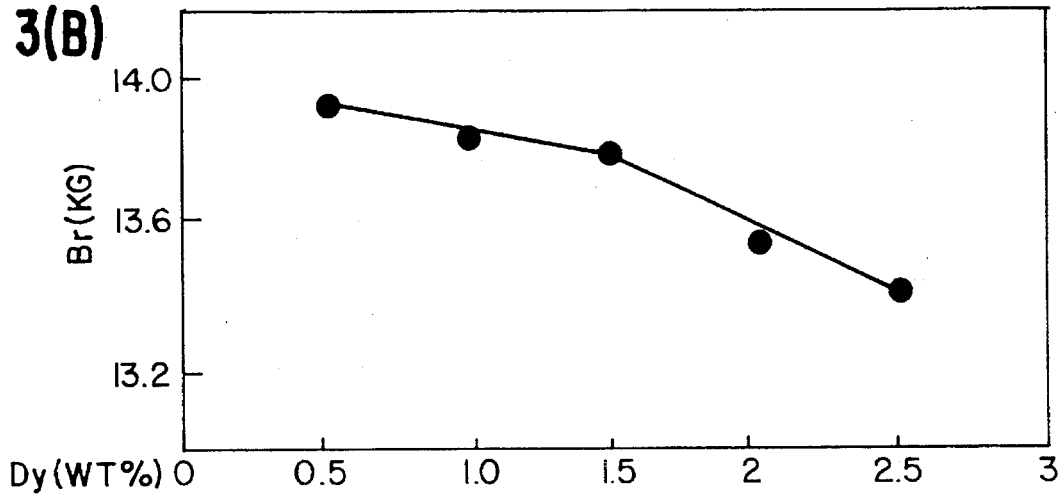
Figure 3C:
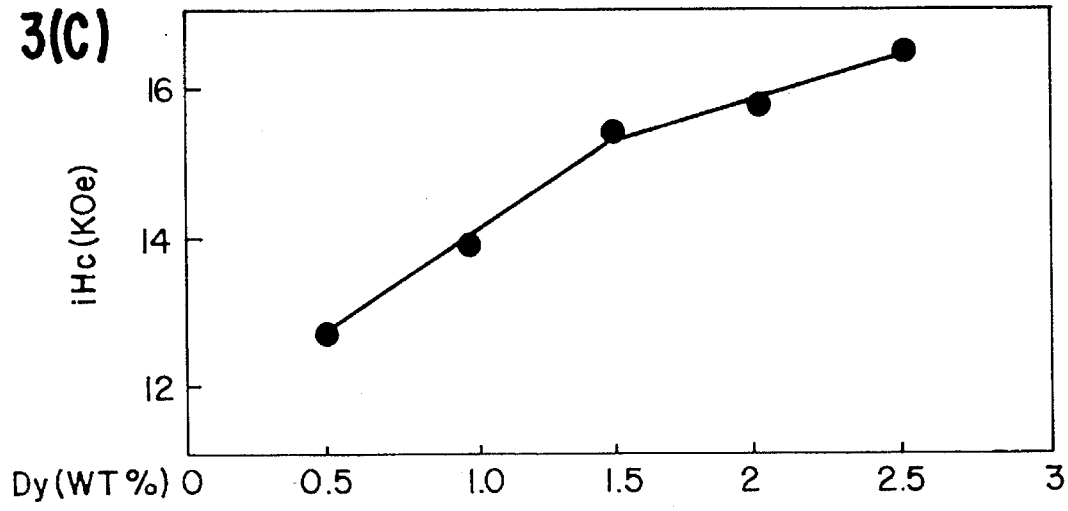

Samples were measured for cold magnetic characteristic, and results obtained are shown in FIG. 1 to FIG. 3.

FIG. 1 is a graph showing the relation between Nd content and magnetic characteristic when Dy is 1.0 wt. % and Ga is 0.06 wt. %. When the Nd content is increased, coercive force iHc is improved but residual magnetic flux density Br is inclined to lower conversely.

FIG. 2 is a graph showing the relation between Ga content and magnetic characteristic when Dy is 1.0 wt. % and Nd is 29 wt. %. When the Ga content is increased, coercive force iHc is improved but, when it is about 0.08 wt. %, its effect is saturated. In addition, the lowering of residual magnetic flux density Br in that duration is little.

FIG. 3 is a graph showing the relation between Dy content and magnetic characteristic when Nd is 29 wt. % and Ga is 0.06 wt. %. When the Dy content is increased, coercive force iHc is improved but the lowering of residual magnetic flux density Br is conspicuous, and maximum energy product (BH)max is also degraded.

It is seen from FIG. 1 to FIG. 3 that to obtain both remarkable maximum energy product (BH)max and coercive force iHc, it is necessary to optimize Nd content and to add Dy and Ga in appropriate amounts.

EXAMPLE 2

Metallic Nd, metallic Dy, Fe, Co, ferro-B, ferro-V and metallic Ga were prepared in a certain weight and melted in a vacuum to produce a 10-kg ingot. This ingot had the following composition in weight %.

Composition:

$$Nd_a\text{-}Dy_b\text{-}B_{1.04}\text{-}V_{0.59}\text{-}Ga_c\text{-}Co_{0.20}\text{-}Al_{0.35}\text{-}Fe_{balance}$$

This ingot was processed in same ways as Example 1 to obtain fine powder having an average grain diameter of 4.0 micrometers (F.S.S.S.) and oxygen content of 5300 ppm. The fine powder was then press-molded and magnetized under same conditions as Example 1 to prepare a compact of 20×20×15 (mm).

The compact was sintered and heat-treated under same conditions as Example 1 so as to achieve a sintered body having a density of 7.55 to 7.58 g/cc and oxygen content of 1100 to 4000 ppm.

Figure 4A:
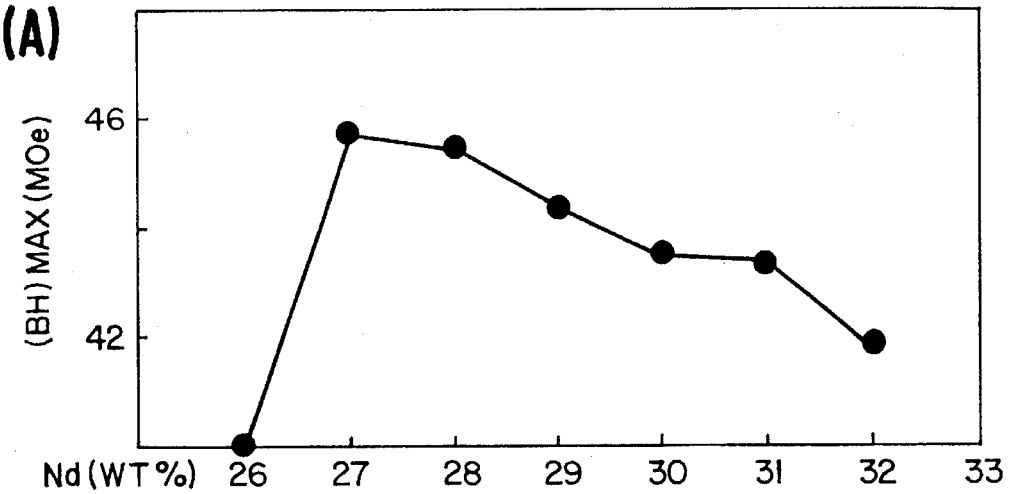
FIG. 4 is a graph showing the relation among Nd content, maximum energy product (BH)max, residual magnetic flux density Br and coercive force iHc of a Nd-Fe-Co-B system sintered magnet.
Figure 4B:
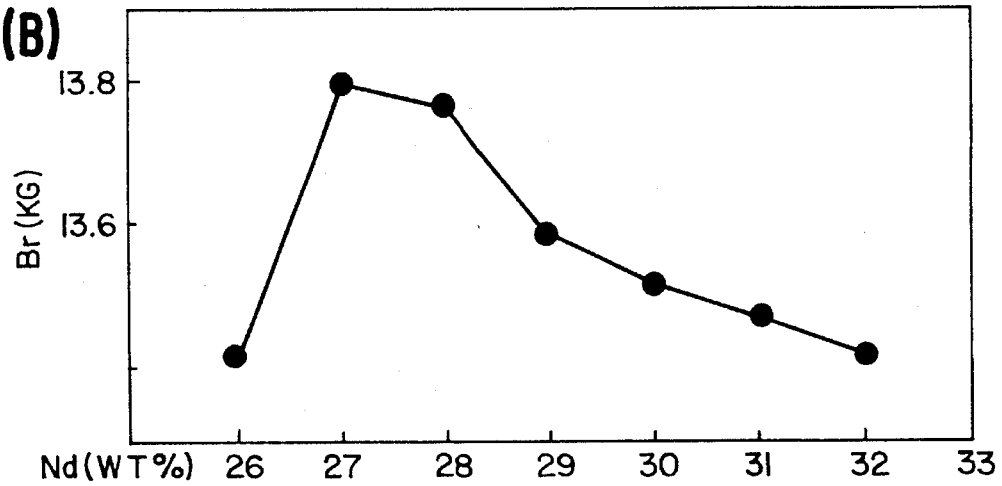
Figure 4C:
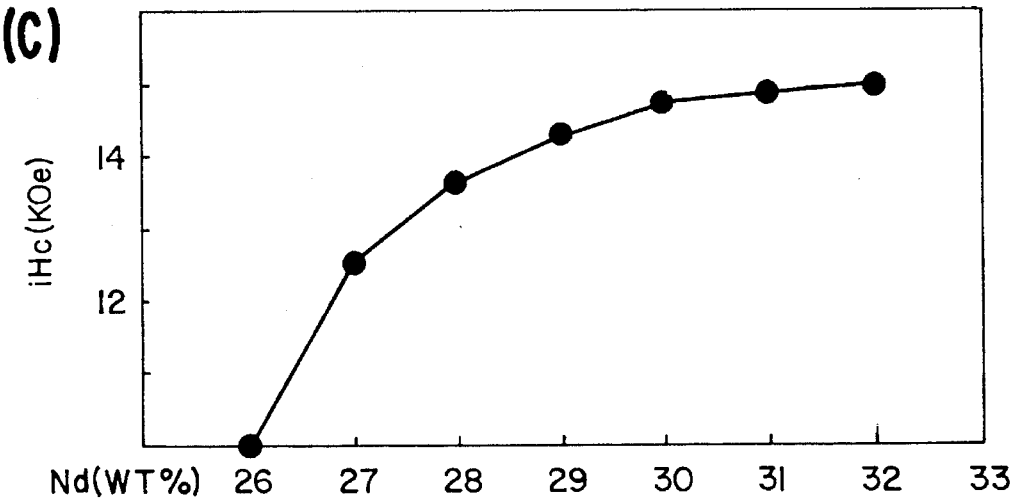
Figure 5A:
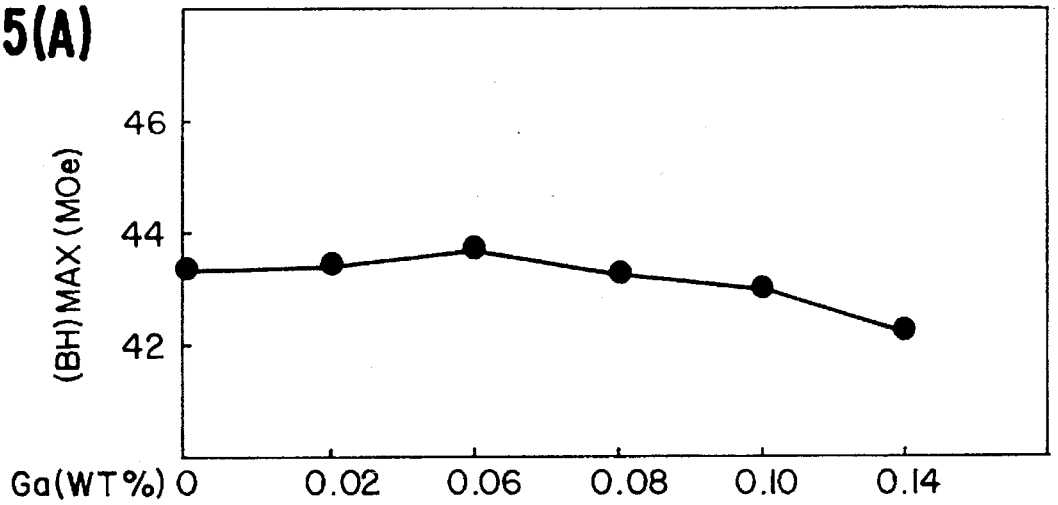
FIG. 5 is a graph showing the relation among Ga content, maximum energy product (BH)max, residual magnetic flux density Br and coercive force iHc of a Nd-Fe-Co-B system sintered magnet.
Figure 5B:
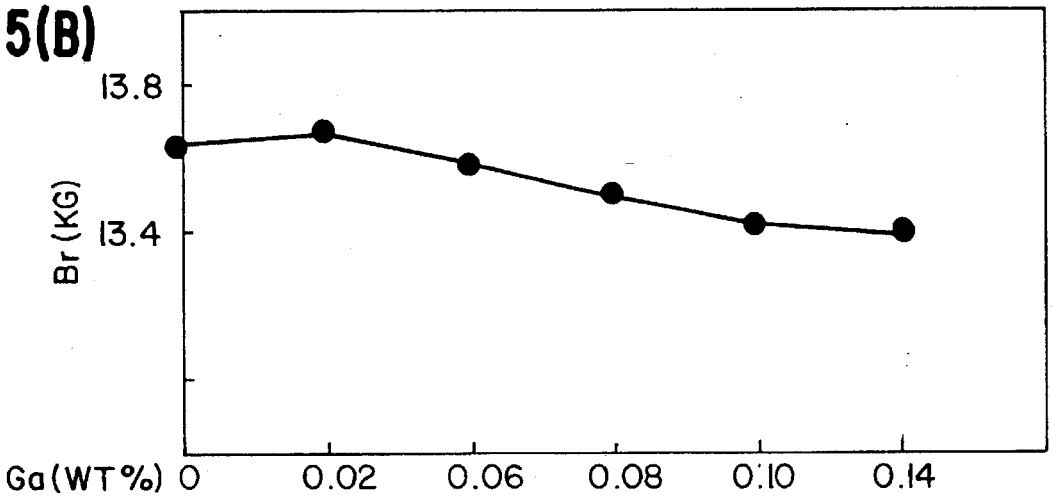
Figure 5C:
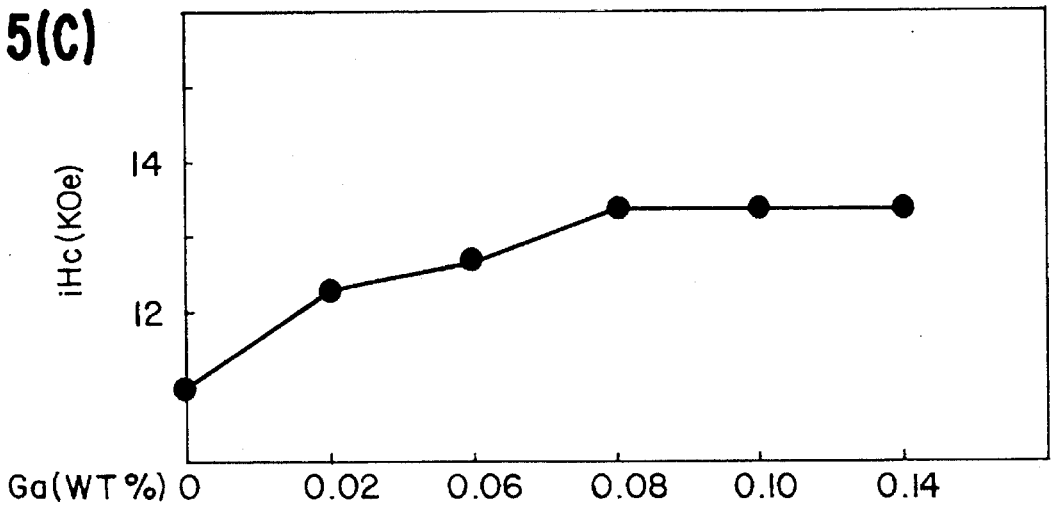
Figure 6A:
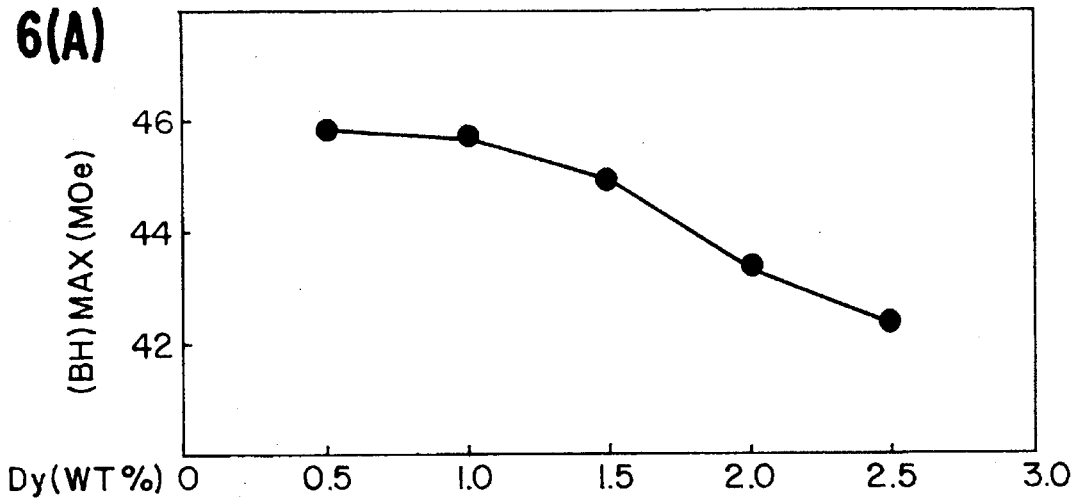
FIG. 6 is a graph showing the relation among Dy content, maximum energy product (BH)max, residual magnetic flux density Br and coercive force iHc of a Nd-Fe-Co-B system sintered magnet.
Figure 6B:
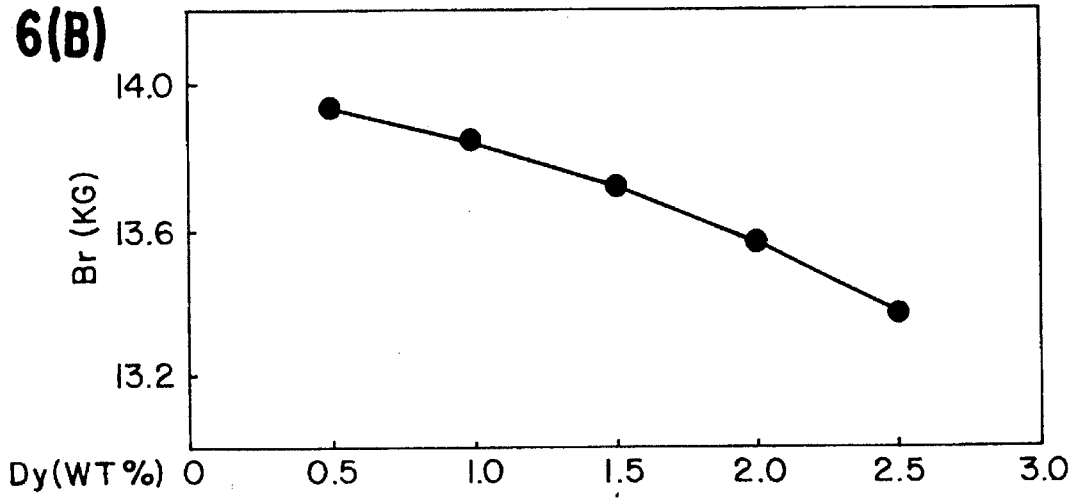
Figure 6C:
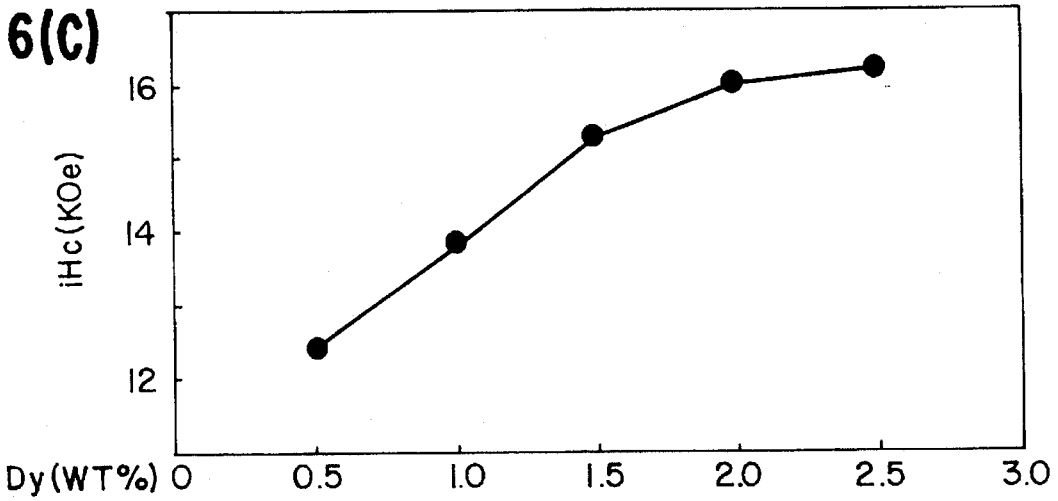

Samples were measured for cold magnetic characteristic, and results obtained are shown in FIG. 4, FIG. 5 and FIG. 6.

FIG. 4 is a graph showing the relation between Nd content and magnetic characteristic when Dy is 1.0 wt. % and Ga is 0.06 wt. %. When the Nd content is increased, coercive force iHc is improved but residual magnetic flux density Br is inclined to lower conversely.

FIG. 5 is a graph showing the relation between Ga content and magnetic characteristic when Dy is 1.0 wt. % and Nd is 29 wt. %. When the Ga content is increased, coercive force iHc is improved but, when it is about 0.08 wt. %, its effect is saturated. In addition, the lowering of residual magnetic flux density Br in that duration is little.

FIG. 6 is a graph showing the relation between Dy content and magnetic characteristic when Nd is 29 wt. % and Ga is 0.06 wt. %. When the Dy content is increased, coercive force iHc is improved while the lowering of residual magnetic flux density Br is excessive, and maximum energy product (BH)max is also degraded.

It is seen from FIG. 4 to FIG. 6 that it is essential to optimize Nd content and to add Dy and Ga in appropriate amounts in order to obtain both remarkable maximum energy product (BH)max and coercive force iHc.

EXAMPLE 3

Metallic Nd, metallic Dy, Fe, ferro-B, ferro-Nb and metallic Ga were prepared in a certain weight and melted in a vacuum to produce a 10-kg ingot. This ingot had the following composition in weight %.

Composition:

$$Nd_a\text{-}Dy_b\text{-}B_{1.05}\text{-}Nb_{0.60}\text{-}Ga_c\text{-}Al_{0.20}\text{-}Fe_{balance}$$

This ingot was processed in same ways as Example 1 to obtain fine powder having an average grain diameter of 4.0 micrometers (F.S.S.S.) and oxygen content of 5200 ppm. The fine powder was then press-molded and magnetized under same conditions as Example 1 to prepare a compact of 20×20×15 (mm).

The compact was sintered and heat-treated under same conditions as Example 1 so as to achieve a sintered body having a density of 7.55 to 7.58 g/cc and oxygen content of 1100 to 4000 ppm.

Figure 7A:
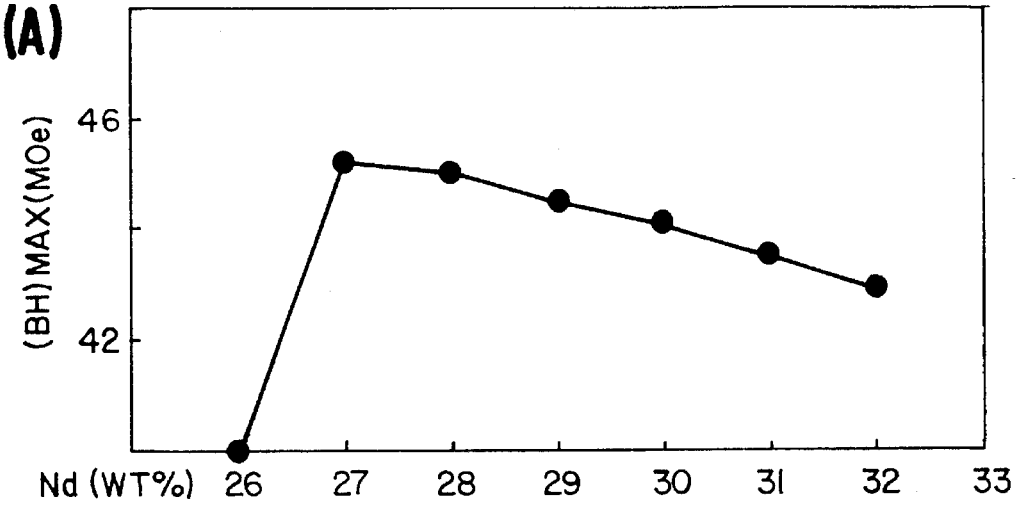
FIG. 7 is a graph showing the relation among Nd content, maximum energy product (BH)max, residual magnetic flux density Br and coercive force iHc of a Nd-Fe-B system sintered magnet.
Figure 7B:
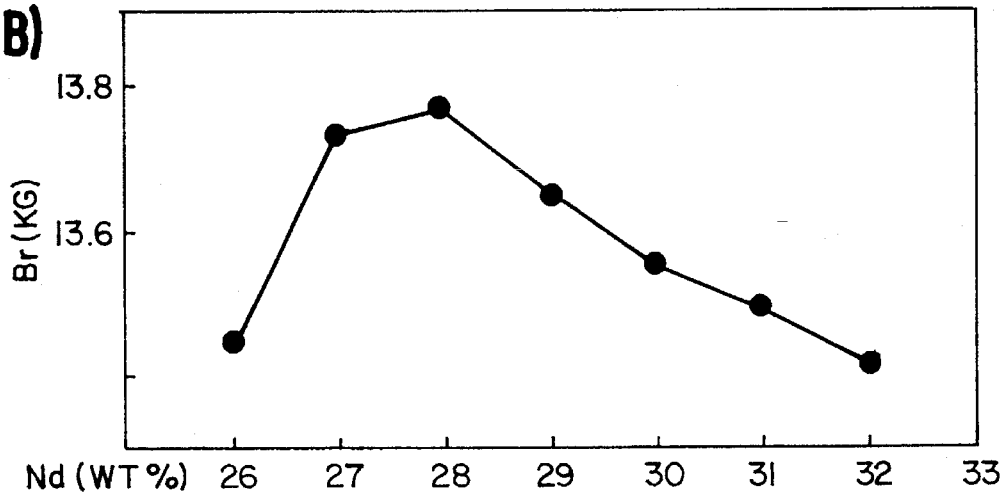
Figure 7C:
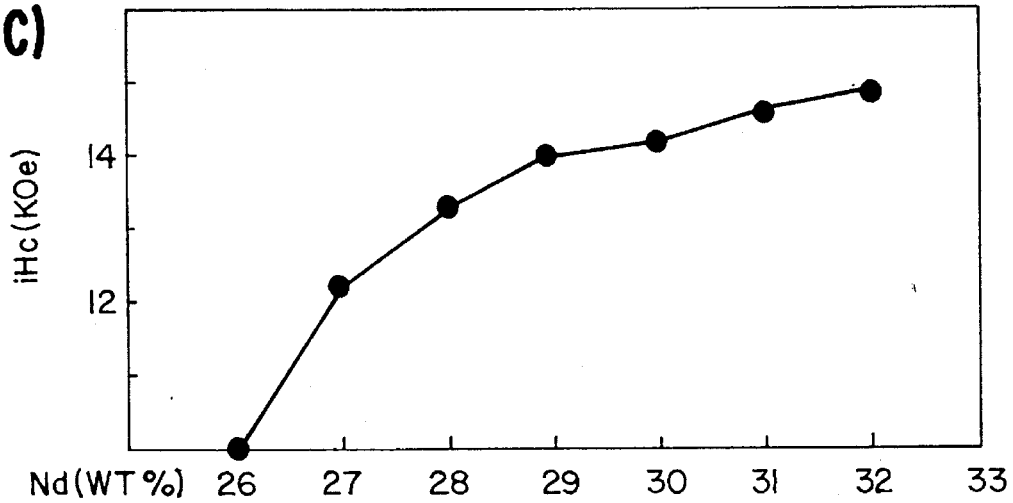
Figure 8A:
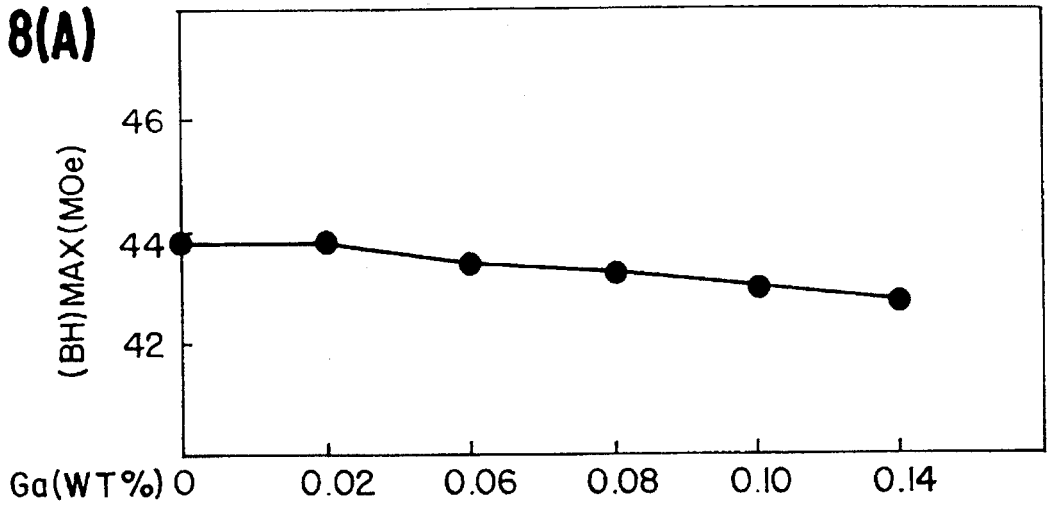
FIG. 8 is a graph showing the relation among Ga content, maximum energy product (BH)max, residual magnetic flux density Br and coercive force iHc of a Nd-Fe-B system sintered magnet.
Figure 8B:
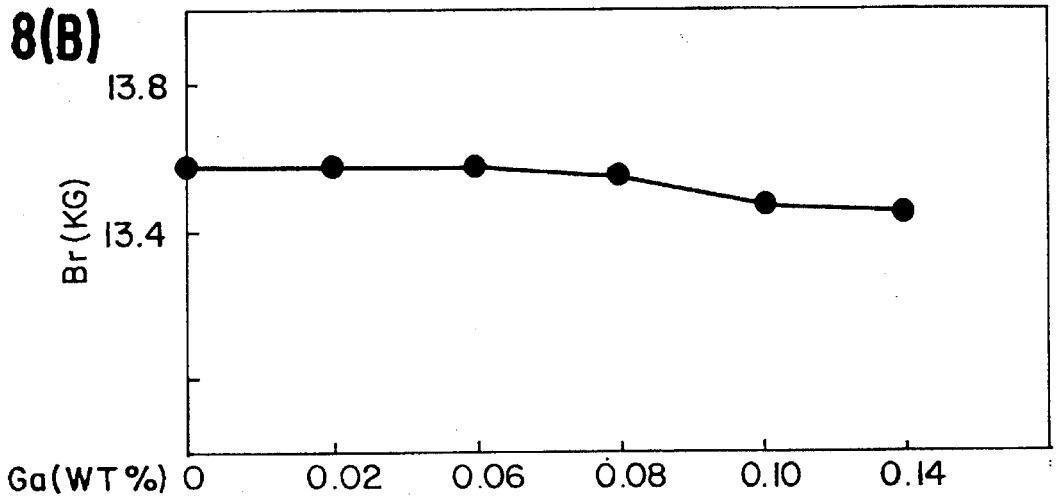
Figure 8C:
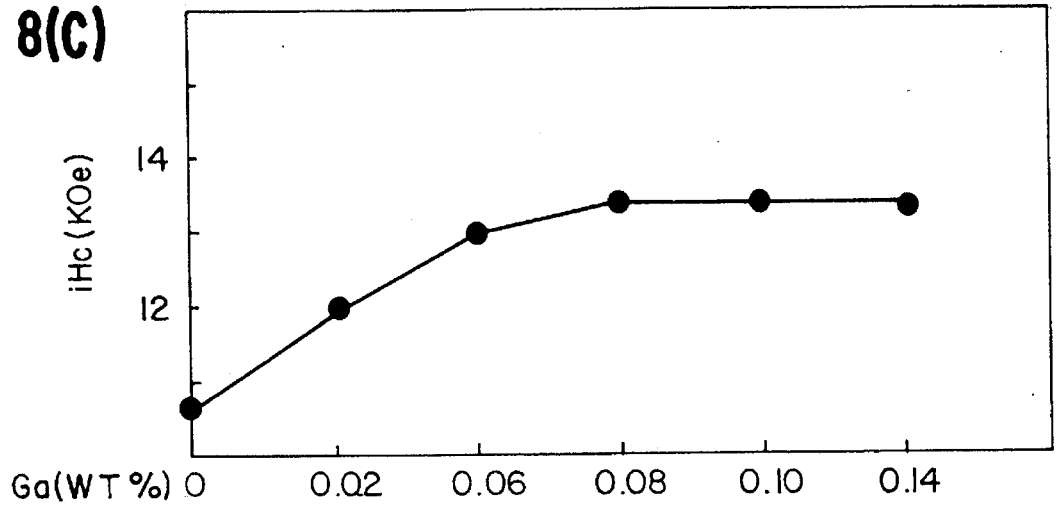
Figure 9A:
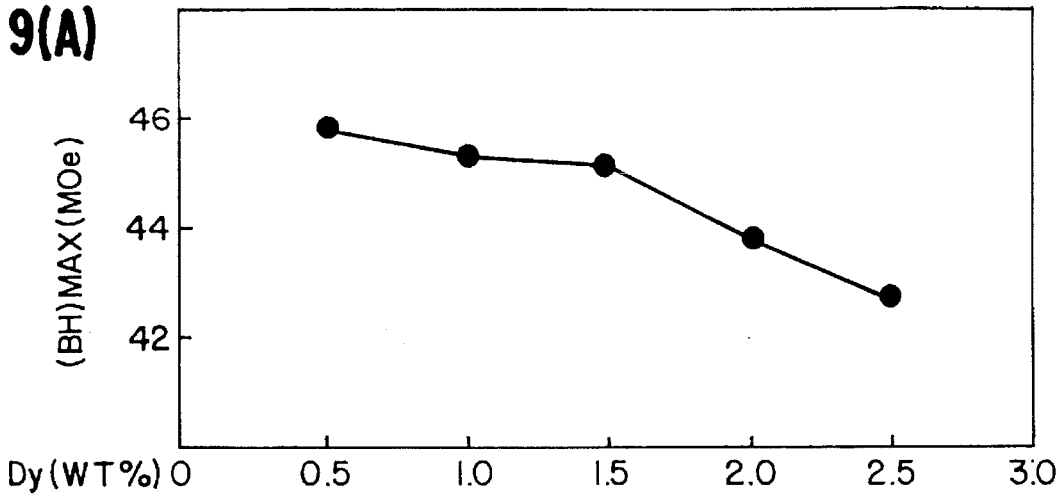
FIG. 9 is a graph showing the relation among Dy content, maximum energy product (BH)max, residual magnetic flux density Br and coercive force iHc of a Nd-Fe-B system sintered magnet.
Figure 9B:
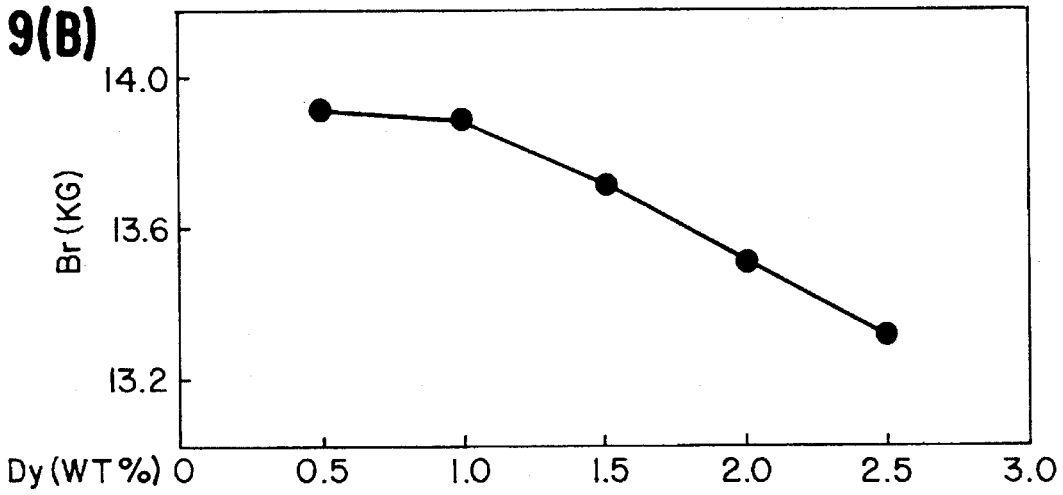
Figure 9C:
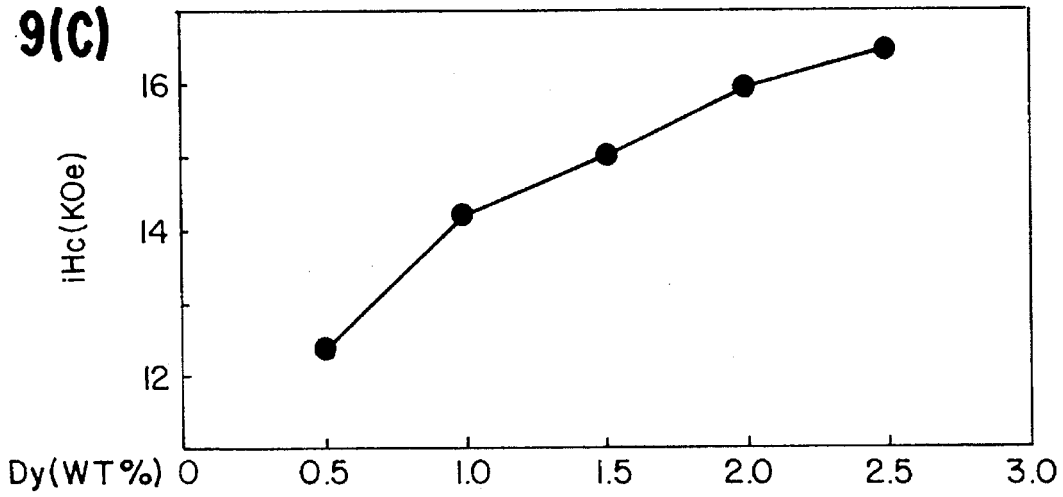

Samples were measured for cold magnetic characteristic, and results obtained are shown in FIG. 7, FIG. 8 and FIG. 9.

FIG. 7 is a graph showing the relation between Nd content and magnetic characteristic when Dy is 1.0 wt. % and Ga is 0.06 wt. %. When the Nd content is increased, coercive force iHc is improved but residual magnetic flux density Br is inclined to lower conversely.

FIG. 8 is a graph showing the relation between Ga content and magnetic characteristic when Dy is 1.0 wt. % and Nd is 29 wt. %. When the Ga content is increased, coercive force iHc is improved but, when it is about 0.08 wt. %, its effect is saturated. In addition, the lowering of residual magnetic flux density Br in that duration is not much.

FIG. 9 is a graph showing the relation between Dy content and magnetic characteristic when Nd is 29 wt. % and Ga is 0.06 wt. %. When the Dy content is increased, coercive force iHc is improved while the lowering of residual magnetic flux density Br is conspicuous, and maximum energy product (BH)max is also degraded.

It is seen from FIG. 7 to FIG. 9 that to obtain both remarkable maximum energy product (BH)max and coercive force iHc, it is necessary to optimize Nd content and to add Dy and Ga in appropriate amounts.

EXAMPLE 4

Metallic Nd, metallic Dy, Fe, ferro-B, ferro-V and metallic Ga were prepared in a certain weight and melted in a vacuum to produce a 10-kg ingot. This ingot had the following composition in weight %.

Composition:

$$Nd_a\text{-}Dy_b\text{-}B_{1.00}\text{-}V_{0.60}\text{-}Ga_c\text{-}Al_{0.17}\text{-}Fe_{balance}$$

This ingot was processed in same ways as Example 1 to obtain fine powder having an average grain diameter of 4.0 micrometers (F.S.S.S.) and oxygen content of 5500 ppm. The fine powder was then press-molded and magnetized under same conditions as Example 1 to prepare a compact of 20×20×15 (mm).

The compact was sintered and heat-treated under same conditions as Example 1 so as to achieve a sintered body having a density of 7.55 to 7.58 g/cc and oxygen content of 1000 to 4100 ppm.

Figure 10A:
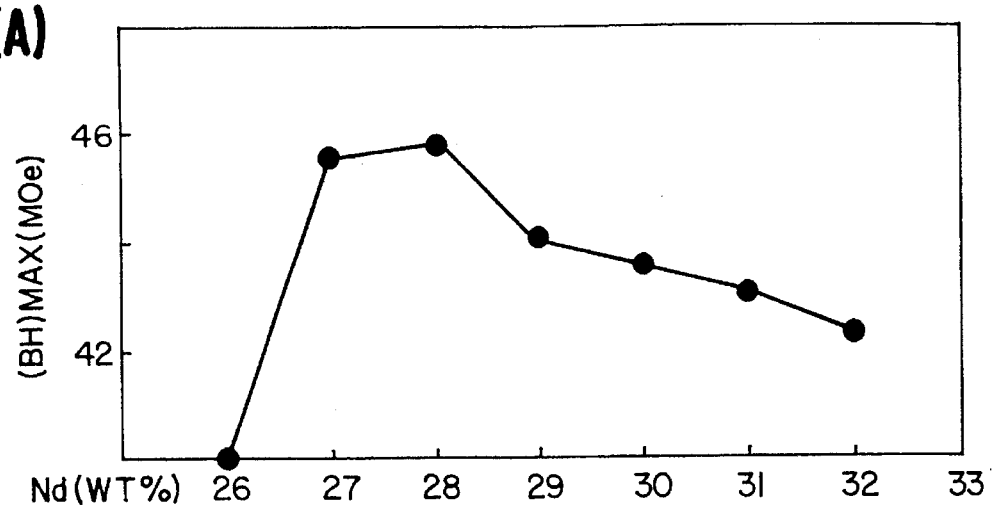
FIG. 10 is a graph showing the relation among Nd content, maximum energy product (BH)max, residual magnetic flux density Br and coercive force iHc of a Nd-Fe-B system sintered magnet.
Figure 10B:
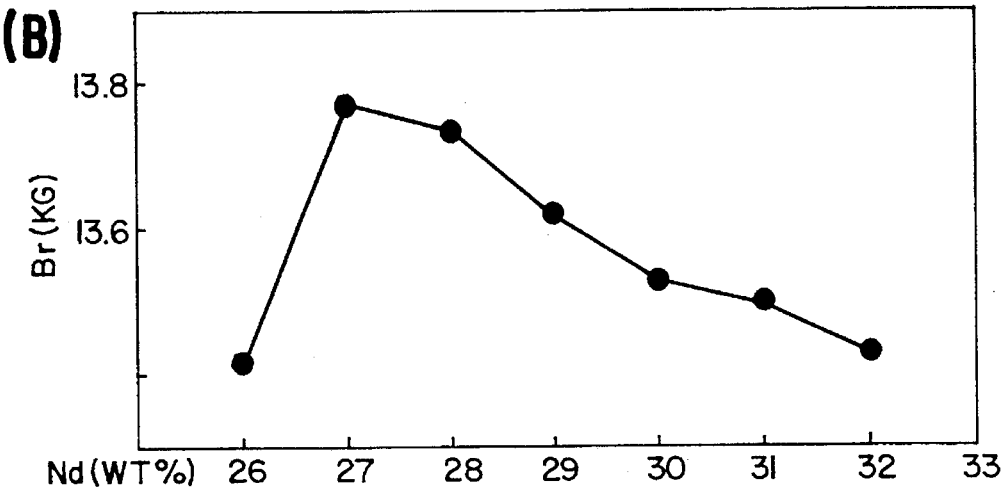
Figure 10C:
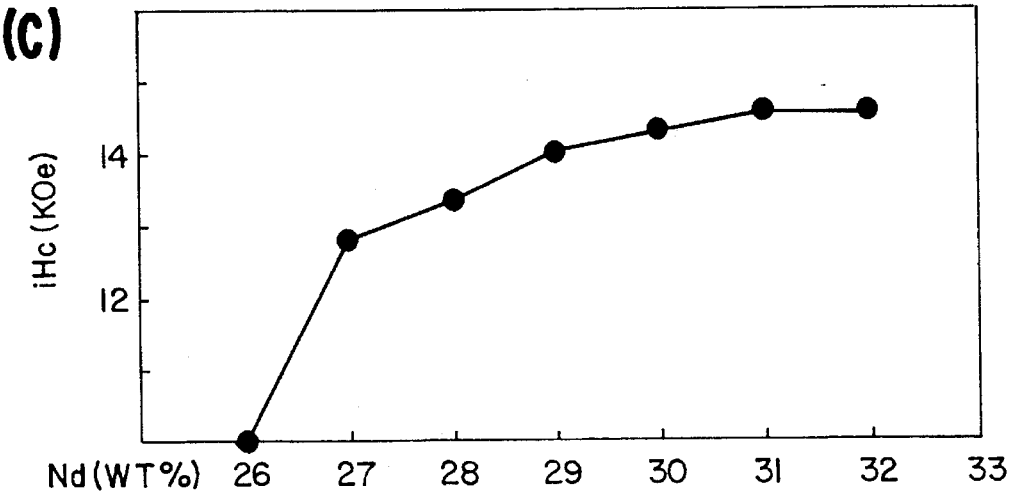
Figure 11A:
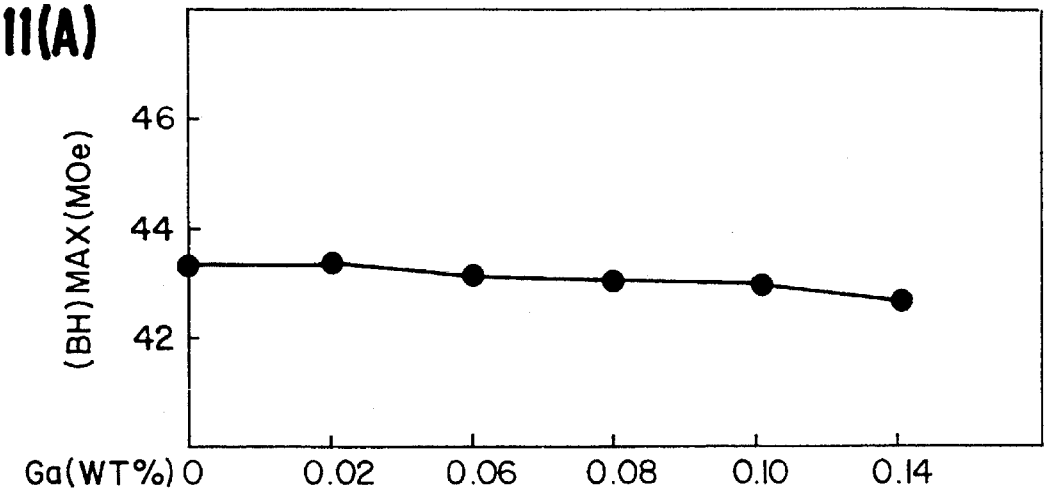
FIG. 11 is a graph showing the relation among Ga content, maximum energy product (BH)max, residual magnetic flux density Br and coercive force iHc of a Nd-Fe-B system sintered magnet.
Figure 11B:
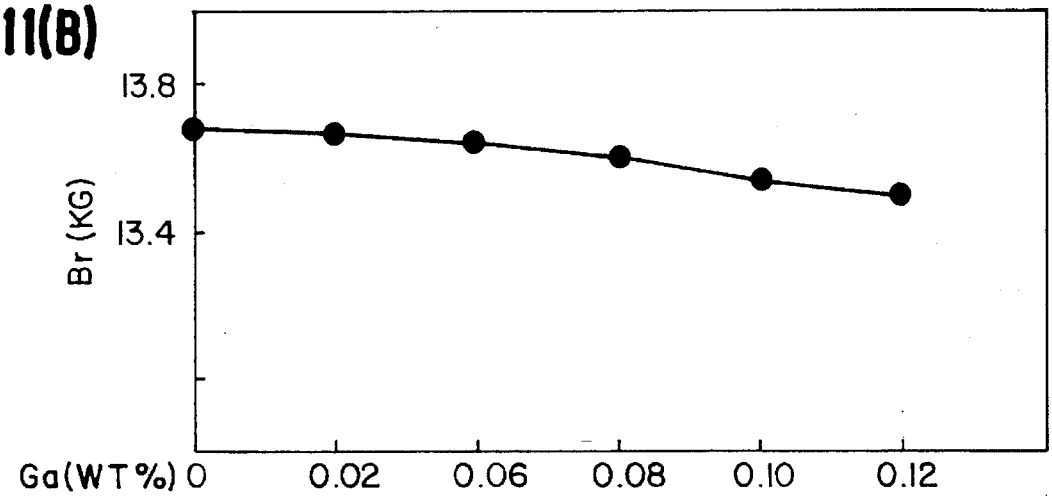
Figure 11C:
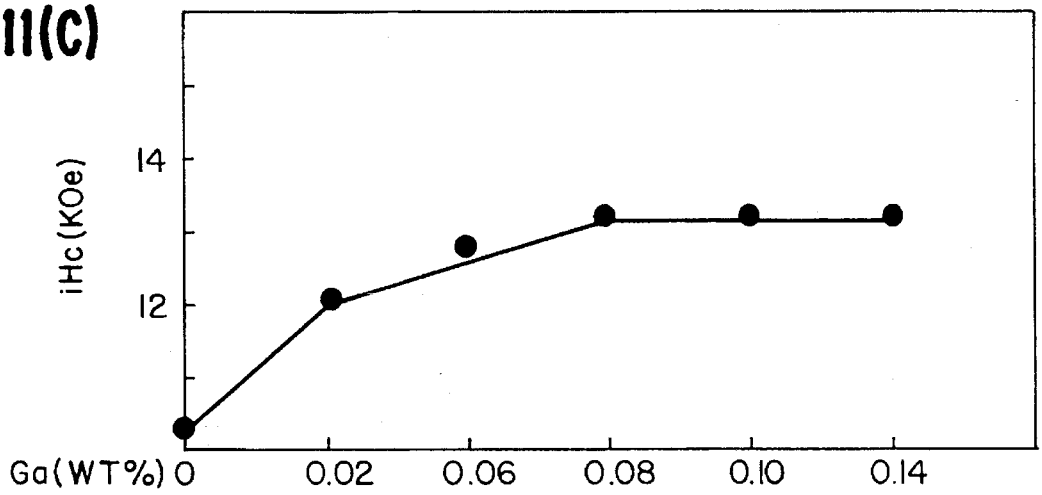
Figure 12A:
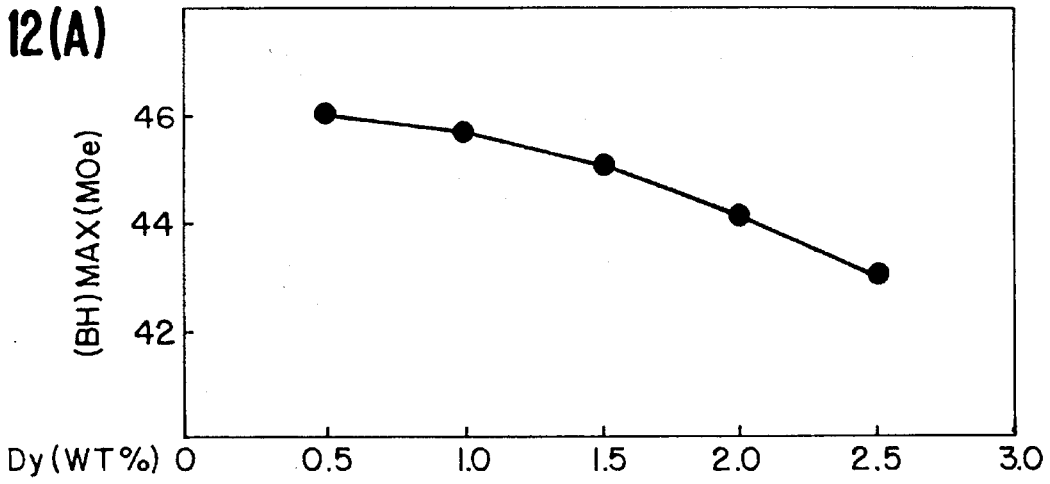
FIG. 12 is a graph showing the relation among Dy content, maximum energy product (BH)max, residual magnetic flux density Br and coercive force iHc of a Nd-Fe-B system sintered magnet.
Figure 12B:
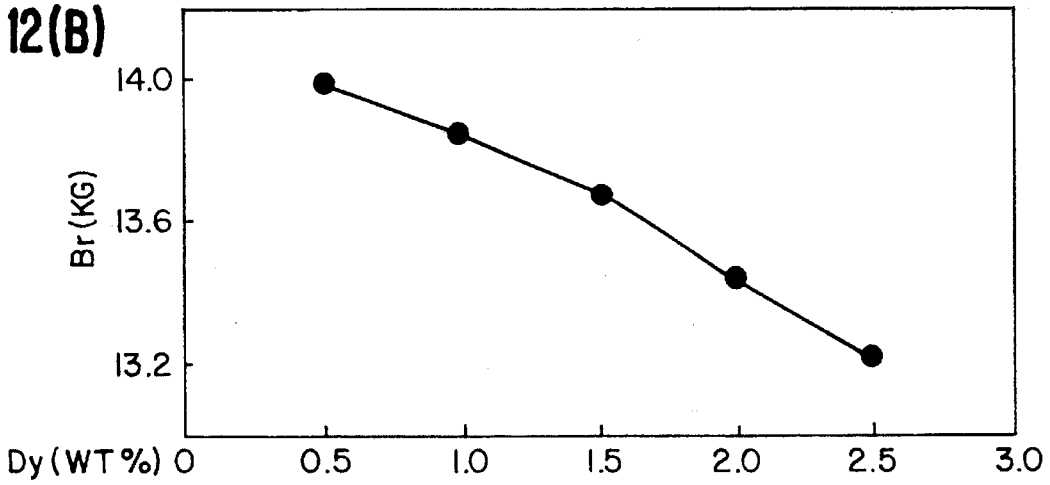
Figure 12C:
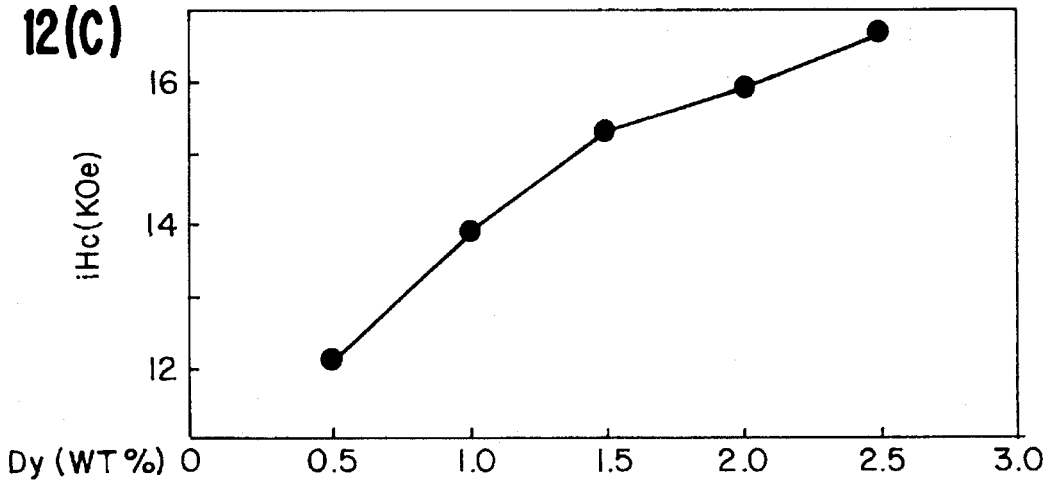

Samples were measured for cold magnetic characteristic, and results obtained are shown in FIG. 10, FIG. 11 and FIG. 12.

FIG. 10 is a graph showing the relation between Nd content and magnetic characteristic when Dy is 1.0 wt. % and Ga is 0.06 wt. %. When the Nd content is increased, coercive force iHc is improved but residual magnetic flux density Br is inclined to lower conversely.

FIG. 11 is a graph showing the relation between Ga content and magnetic characteristic when Dy is 1.0 wt. % and Nd is 29 wt. %. When the Ga content is increased, coercive force iHc is improved but, when it is about 0.08 wt. %, its effect is saturated. In addition, the lowering of residual magnetic flux density Br in that duration is little.

FIG. 12 is a graph showing the relation between Dy content and magnetic characteristic when Nd is 29 wt. % and Ga is 0.06 wt. %. When the Dy content is increased, coercive force iHc is improved while the lowering of residual magnetic flux density Br is excessive, and maximum energy product (BH)max is also degraded.

It is seen from FIG. 11 to FIG. 12 that it is essential to optimize Nd content and to add Dy and Ga in appropriate amounts in order to obtain both remarkable maximum energy product (BH)max and coercive force iHc.

EXAMPLE 5

Metallic Nd, metallic Dy, Fe, Co, ferro-B, ferro-Nb and metallic Ga were prepared in a certain weight and melted in a vacuum to produce a 10-kg Ingot. This ingot had the following composition in weight %.

Composition:

$$Nd_{29.5}\text{-}Dy_{1.2}\text{-}B_{1.03}\text{-}Nb_{0.33}\text{-}Ga_{0.06}\text{-}Co_{0.30}\text{-}Al_{0.36}\text{-}Fe_{balance}$$

This ingot was processed in same ways as Example 1 to obtain fine powder having an average grain diameter of 4.0 micrometers (F.S.S.S.). In this step, a small volume of oxygen was mixed in the inert gas to obtain fine powder with variable oxygen contents. The fine powder was then press-molded and magnetized under same conditions as Example 1 to prepare a compact of 20×20×15 (mm).

The compact was sintered and heat-treated under same conditions as Example 1 so as to achieve a sintered body having a density of 7.55 to 7.58 g/cc and oxygen content of 1000 to 6000 ppm.

Figure 13A:
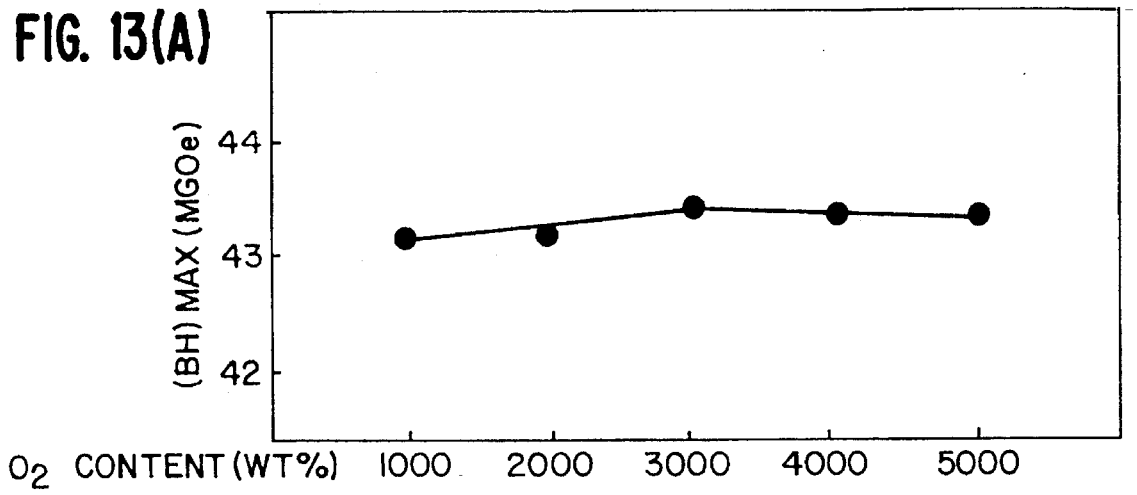
FIG. 13 is a graph showing the relation among oxygen content, maximum energy product (BH)max and coercive force iHc of a Nd-Fe-Co-B system sintered magnet.
Figure 13B:
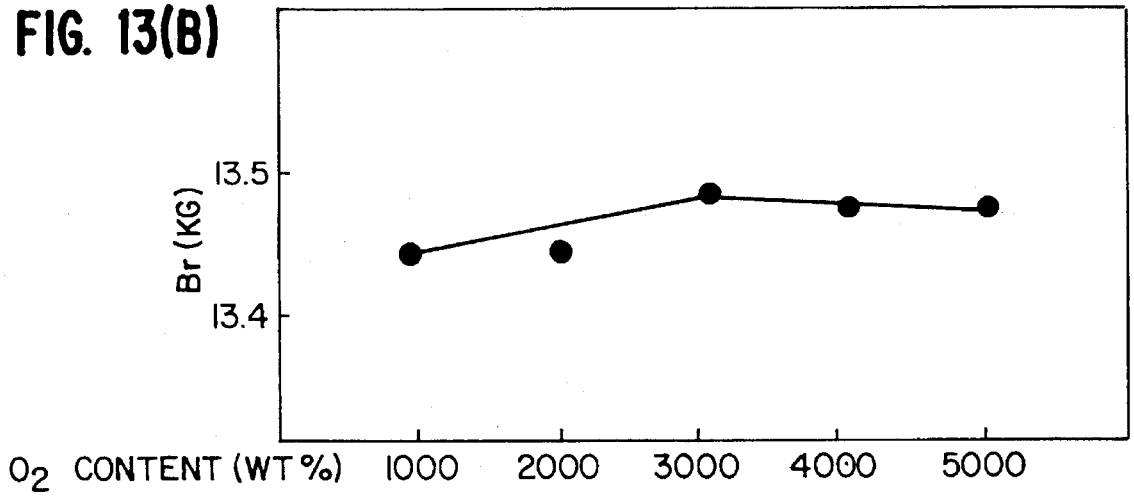
Figure 13C:
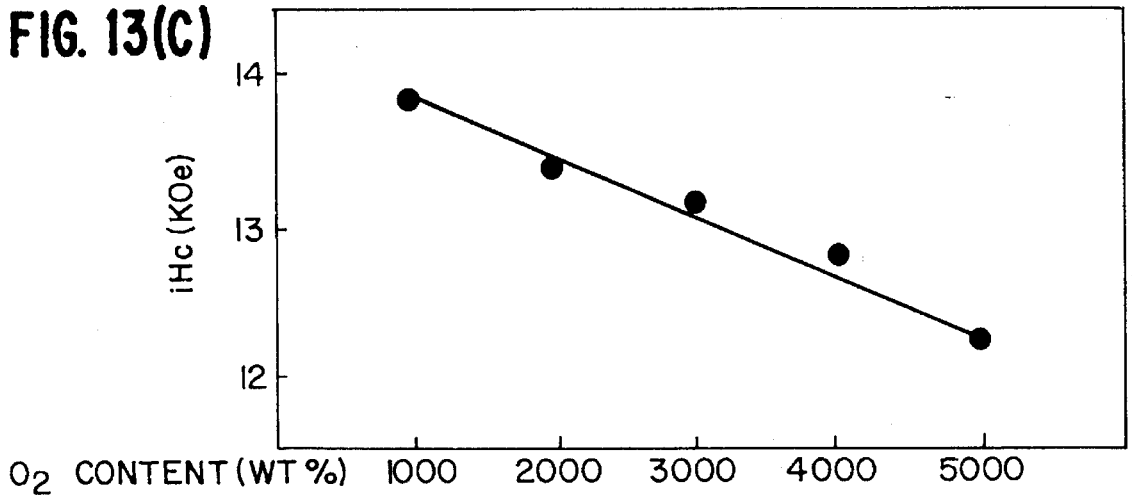

Samples were measured for cold magnetic characteristic, and results obtained are shown in FIG. 13. As shown in FIG. 13, the oxygen content is determined to be 1000 to 5000 ppm because coercive force iHc is sharply lowered when it exceeds 5000 ppm.

Figure 14A:
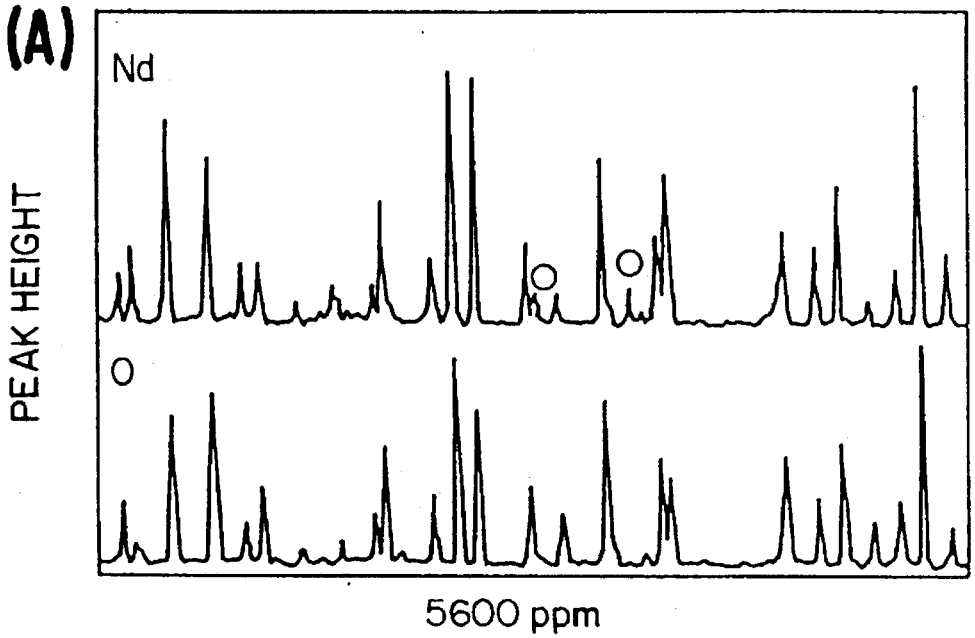
FIG. 14 is a graph showing a linear analysis using EPMA (Electron Probe Micro Analyzer) of Nd and oxygen of two sintered bodies having oxygen content of 5600 ppm and 2000 ppm, respectively.
Figure 14B:
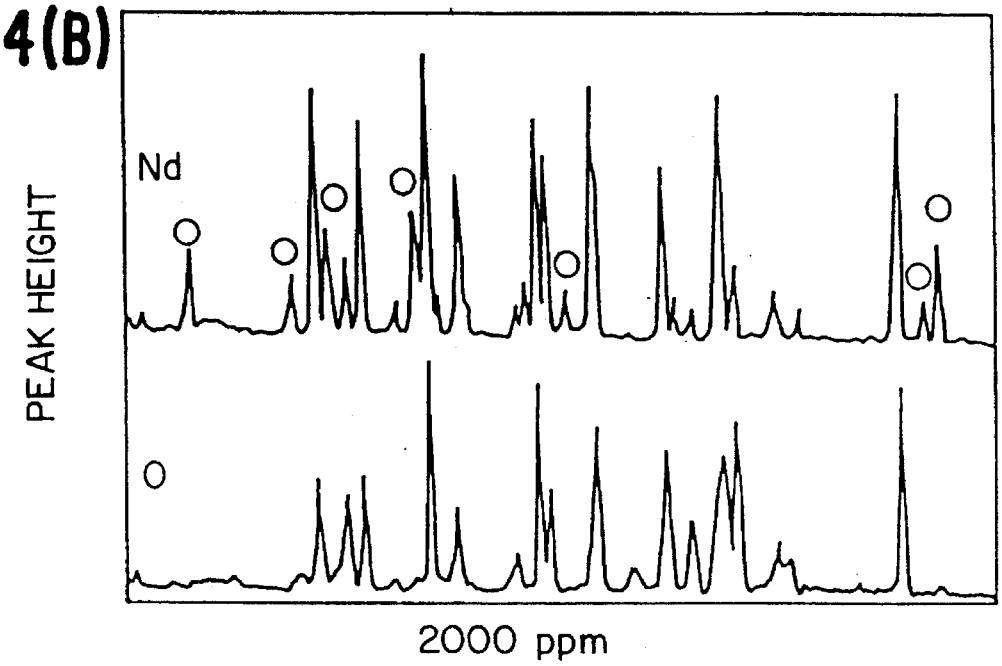

FIG. 14 shows results of a linear analysis with EPMA (Electron Probe Micro Analyzer) of Nd and oxygen of two sintered bodies having oxygen content of 5600 ppm and 2000 ppm, respectively. As to the sintered body with a larger oxygen content, most of Nd peaks and oxygen peaks are overlapped, so that it is considered that a large amount of Nd oxide is produced. On the other hand, the sintered body with a smaller oxygen content is observed to have overlapped Nd peaks and oxygen peaks and also many independently existing Nd peaks. That is to say, the sintered body with a large oxygen content has many Nd oxides not contributing to magnetic characteristic, while the sintered body with a small oxygen content has many Nd contributing to magnetic characteristic improvement. In FIG. 14, portions marked with a circle are peaks that Nd exists independently from oxygen.

EXAMPLE 6

Metallic Nd, metallic Dy, Fe, Co, retro-B, ferro-V and metallic Ga were prepared in a certain weight and melted in a vacuum to produce a 10-kg ingot. This ingot had the following composition in weight %.

Composition:

$$Nd_{29.5}\text{-}Dy_{1.2}\text{-}B_{1.03}\text{-}V_{0.35}\text{-}Ga_{0.05}\text{-}Co_{0.30}\text{-}Al_{0.33}\text{-}Fe_{balance}$$

This ingot was processed in same ways as Example 1 to obtain fine powder having an average grain diameter of 4.0 micrometers (F.S.S.S.). In this step, a small volume of oxygen was mixed in the inert gas to obtain fine powder with variable oxygen contents. The fine powder was then press-molded and magnetized under same conditions as Example 1 to prepare a compact of 20×20×15 (mm).

The compact was sintered and heat-treated under same conditions as Example 1 so as to achieve a sintered body having a density of 7.55 to 7.58 g/cc and oxygen content of 1000 to 5800 ppm.

Figure 15A:
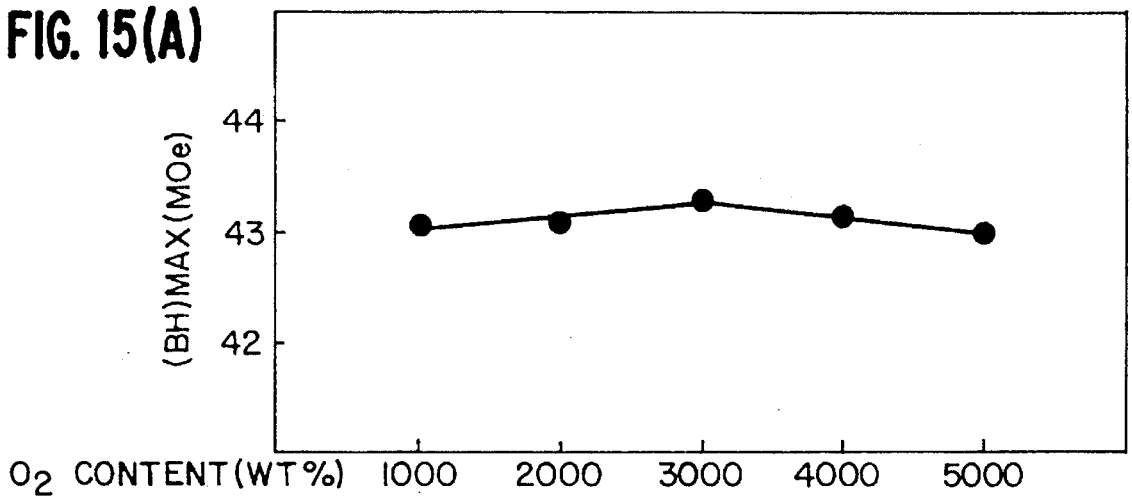
FIG. 15 is a graph showing the relation among oxygen content, maximum energy product (BH)max and coercive force iHc of a Nd-Fe-Co-B system sintered magnet.
Figure 15B:
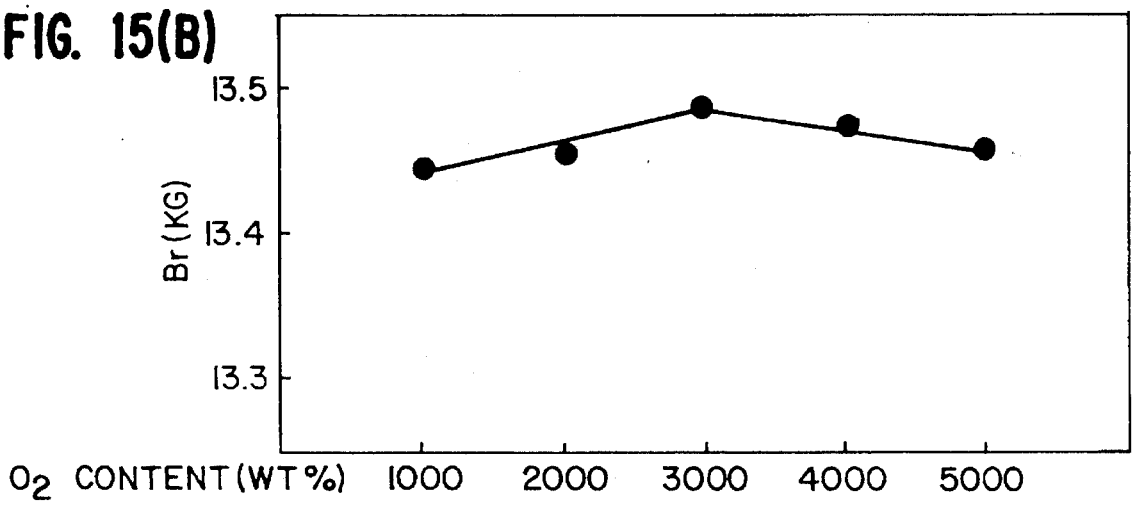
Figure 15C:
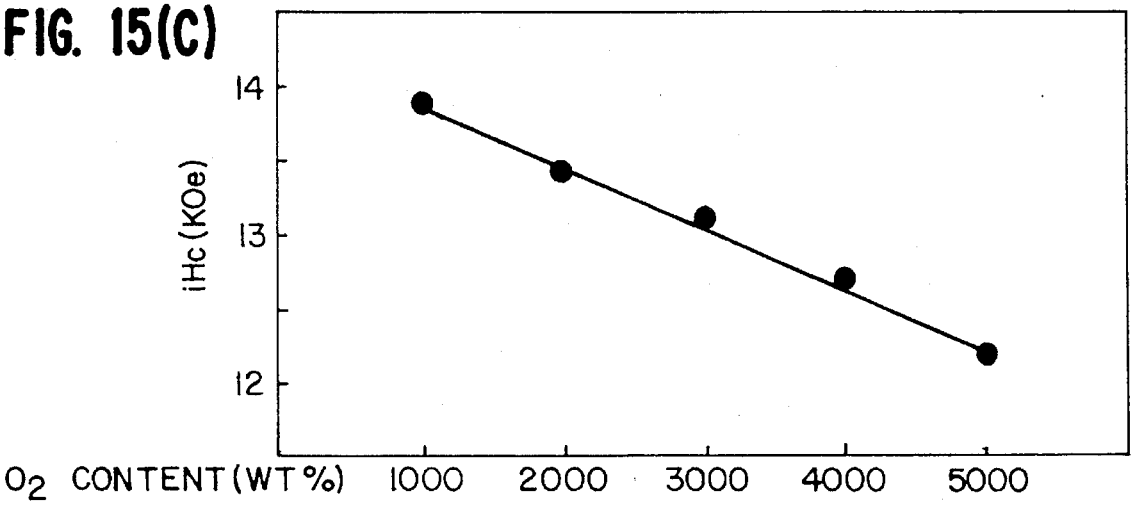

Samples were measured for cold magnetic characteristic, and results obtained are shown in FIG. 15. As shown in FIG. 15, the oxygen content is determined to be 1000 to 5000 ppm because coercive force iHc is sharply lowered when it exceeds 5000 ppm.

EXAMPLE 7

Metallic Nd, metallic Dy, Fe, ferro-B, ferro-Nb and metallic Ga were prepared in a certain weight and melted in a vacuum to produce a 10-kg ingot. This ingot had the following composition in weight %.

Composition:

$$Nd_{29.5}\text{-}Dy_{1.2}\text{-}B_{1.02}\text{-}Nb_{0.33}\text{-}Ga_{0.08}\text{-}Al_{0.18}\text{-}Fe_{balance}$$

This ingot was processed in same ways as Example 1 to obtain fine powder having an average grain diameter of 4.0 micrometers (F.S.S.S.). In this step, a small volume of oxygen was mixed in the inert gas to obtain fine powder with variable oxygen contents. The fine powder was then press-molded and magnetized under same conditions as Example 1 to prepare a compact of 20×20×15 (mm).

The compact was sintered and heat-treated under same conditions as Example 1 so as to achieve a sintered body having a density of 7.55 to 7.58 g/cc and oxygen content of 1000 to 6000 ppm.

Figure 16A:
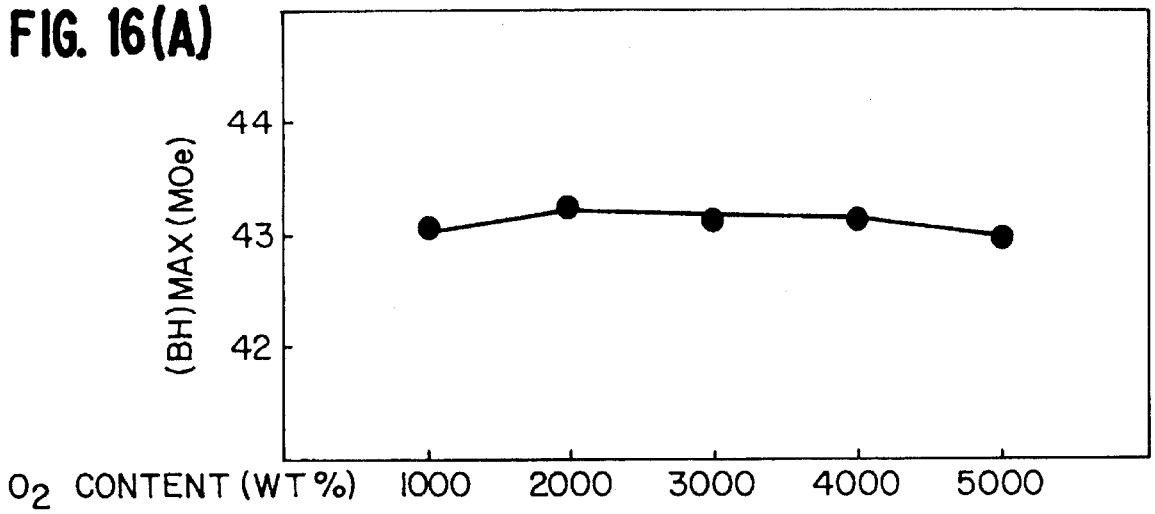
FIG. 16 is a graph showing the relation among oxygen content, maximum energy product (BH)max and coercive force iHc of a Nd-Fe-B system sintered magnet.
Figure 16B:
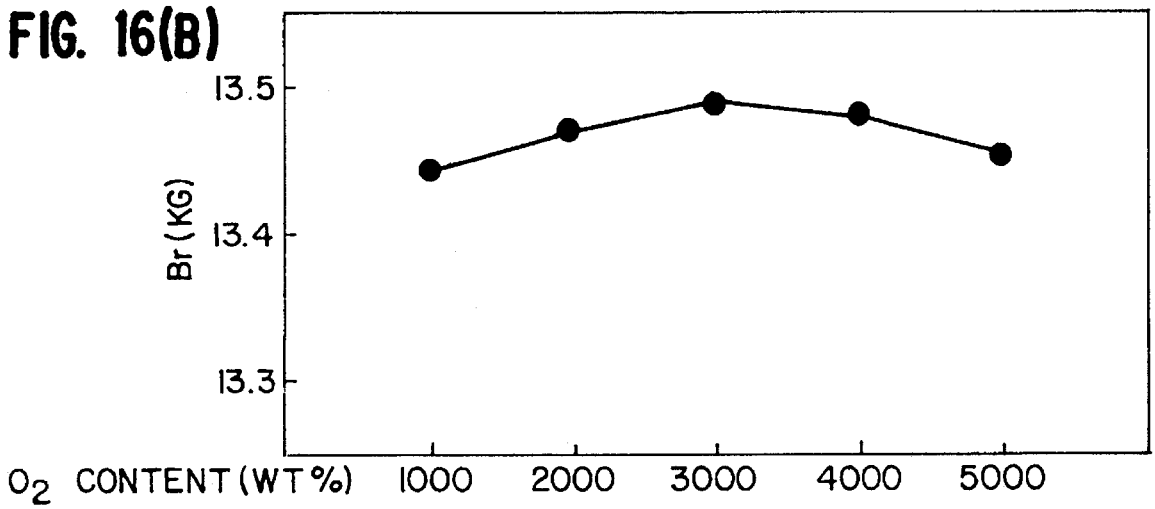
Figure 16C:
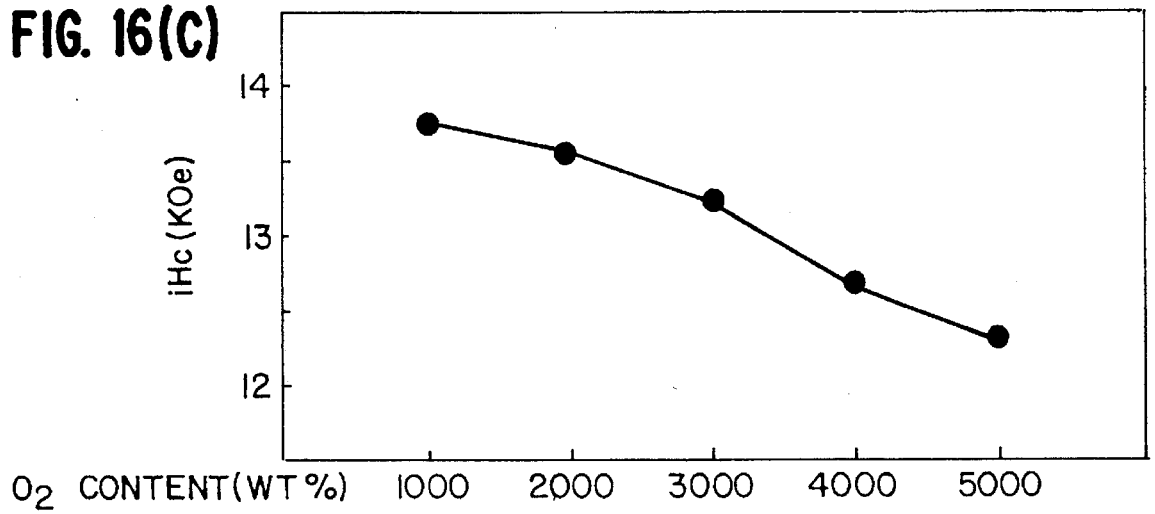

Samples were measured for cold magnetic characteristic, and results obtained are shown in FIG. 16. As shown in FIG. 16, the oxygen content is determined to be 1000 to 5000 ppm because coercive force iHc is sharply lowered when It exceeds 5000 ppm.

EXAMPLE 8

Metallic Nd, metallic Dy, Fe, ferro-B, ferro-V and metallic Ga were prepared in a certain weight and melted in a vacuum to produce a 10-kg ingot. This ingot had the following composition in weight %.

Composition:

$$Nd_{29.5}\text{-}Dy_{1.4}\text{-}B1.05\text{-}V_{0.30}\text{-}Ga_{0.08}\text{-}Al_{0.26}\text{-}Fe_{balance}$$

This ingot was processed in same ways as Example 1 to obtain fine powder having an average grain diameter of 4.0 micrometers (F.S.S.S.). In this step, a small volume of oxygen was mixed In the inert gas to obtain fine powder with variable oxygen contents. The fine powder was then press-molded and magnetized under same conditions as Example 1 to prepare a compact of 20×20×15 (mm).

The compact was sintered and heat-treated under same conditions as Example 1 so as to achieve a sintered body having a density of 7.55 to 7.58 g/cc and oxygen content of 1000 to 5700 ppm.

Figure 17A:
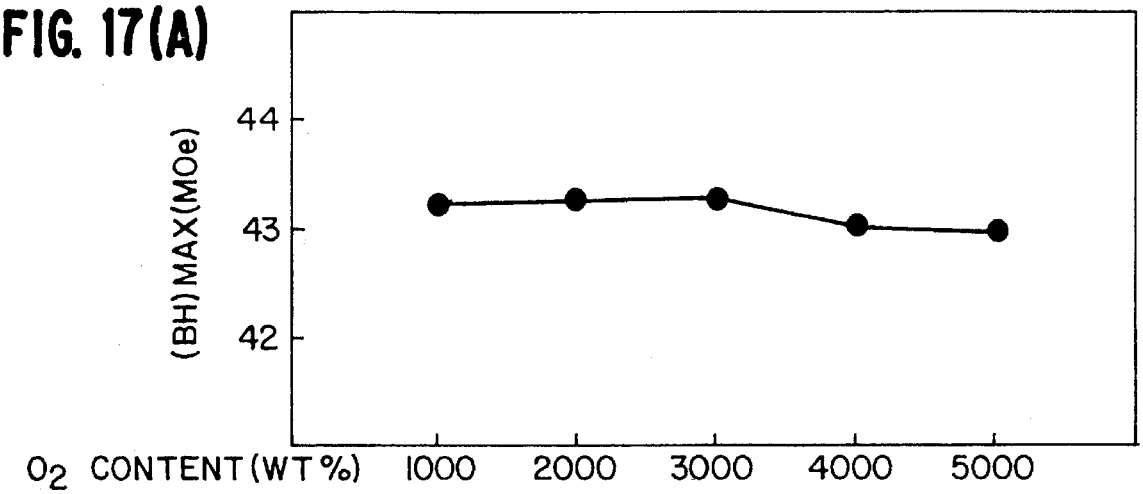
FIG. 17 is a graph showing the relation among oxygen content, maximum energy product (BH)max and coercive force iHc of a Nd-Fe-B system sintered magnet.
Figure 17B:
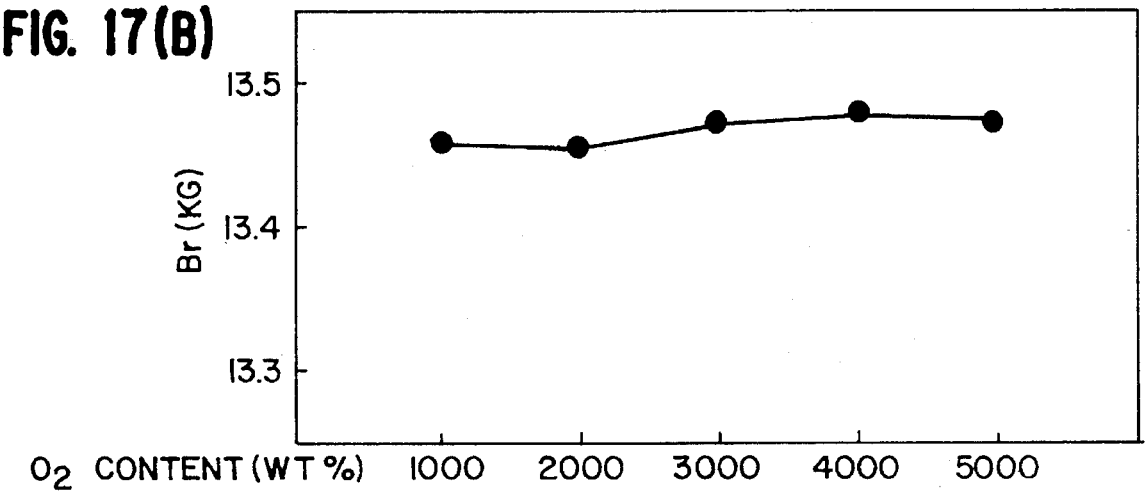
Figure 17C:
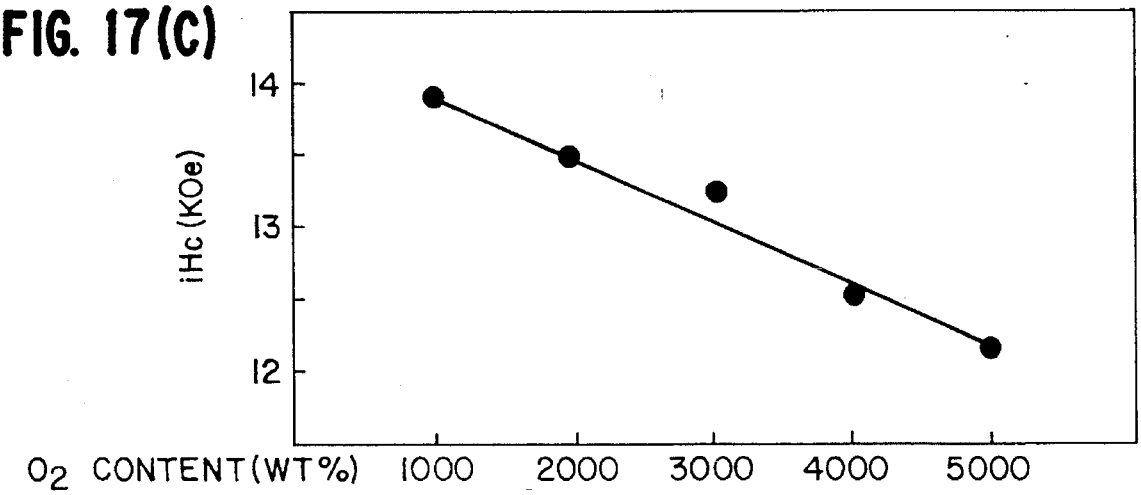

Samples were measured for cold magnetic characteristic, and results obtained are shown in FIG. 17. As shown in FIG. 17, the oxygen content is determined to be 1000 to 5000 ppm because coercive force iHc is sharply lowered when it exceeds 5000 ppm.

EXAMPLE 9

Didym metal (70 wt. % of Nd and 30 wt. % of Pr) and metallic Dy, Fe, Co, ferro-B, ferro-Nb and metallic Ga were prepared in a certain weight and melted in a vacuum to produce a 10-kg ingot. This ingot had the following composition in weight %.

Composition:

$$(Nd+Pr)_{28.5}\text{-}Dy_{0.8}\text{-}B_{1.10}\text{-}Nb_x\text{-}Ga_{0.05}\text{-}Co_{2.23}\text{ -}Al_{0.37}\text{-}Fe_{balance}$$

This ingot was processed in same ways as Example 1 to obtain fine powder having an average grain diameter of 4.0 micrometers (F.S.S.S.). In this step, a small volume of oxygen was mixed in the inert gas to obtain fine powder with variable oxygen contents. The fine powder was then press-molded and magnetized under same conditions as Example 1 to prepare a compact of 20×20×15 (mm).

The compact was sintered and heat-treated under same conditions as Example 1 so as to achieve a sintered body having a density of 7.55 to 7.58 g/cc and oxygen content of 2800 to 4500 ppm.

Figure 18:
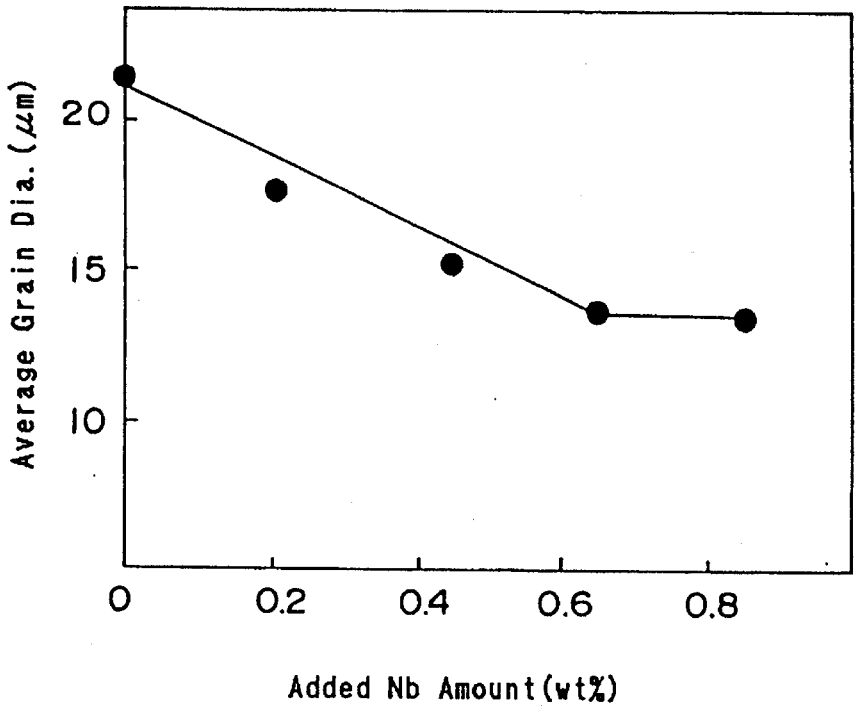
FIG. 18 is a graph showing the relation among average crystalline grain diameter, maximum energy product (BH)max and Nb content of a Nd-Fe-Co-B system sintered magnet.

Samples were measured for cold magnetic characteristic and average grain diameter, and results obtained are shown in FIG. 18. As shown in FIG. 18, inclusion of Nb can suppress the growth of crystal grain when sintering, so that the sintered body can have a small average grain diameter. This contributes to improvement of coercive force the. When Nb is contained in an amount exceeding 2.0 wt. %, the average grain diameter cannot be reduced very much, and maximum energy product (BH)max is lowered sharply. Therefore, Nb is added preferably in an amount of 0.05 to 2.0 wt. %.

EXAMPLE 10

Didym metal (70 wt. % of Nd and 30 wt. % of Pr) and metallic Dy, Fe, Co, ferro-B, ferro-V and metallic Ga were prepared in a certain weight and melted in a vacuum to produce a 10-kg ingot. This ingot had the following composition in weight %.

Composition:

$$(Nd+Pr)_{28.5}\text{-}Dy_{0.6}\text{-}B_{1.05}\text{-}V_x\text{-}Ga_{0.05}\text{-}Co_{2.25}\text{ -}Al_{0.35}\text{-}Fe_{balance}$$

This ingot was processed in same ways as Example 1 to obtain fine powder having an average grain diameter of 4.0 micrometers (F.S.S.S.). In this step, a small volume of oxygen was mixed in the inert gas to obtain fine powder with variable oxygen contents. The fine powder was then press-molded and magnetized under same conditions as Example 1 to prepare a compact of 20×20×15 (mm).

The compact was sintered and heat-treated under same conditions as Example 1 so as to achieve a sintered body having a density of 7.55 to 7.58 g/cc and oxygen content of 2600 to 4400 ppm.

Figure 19:
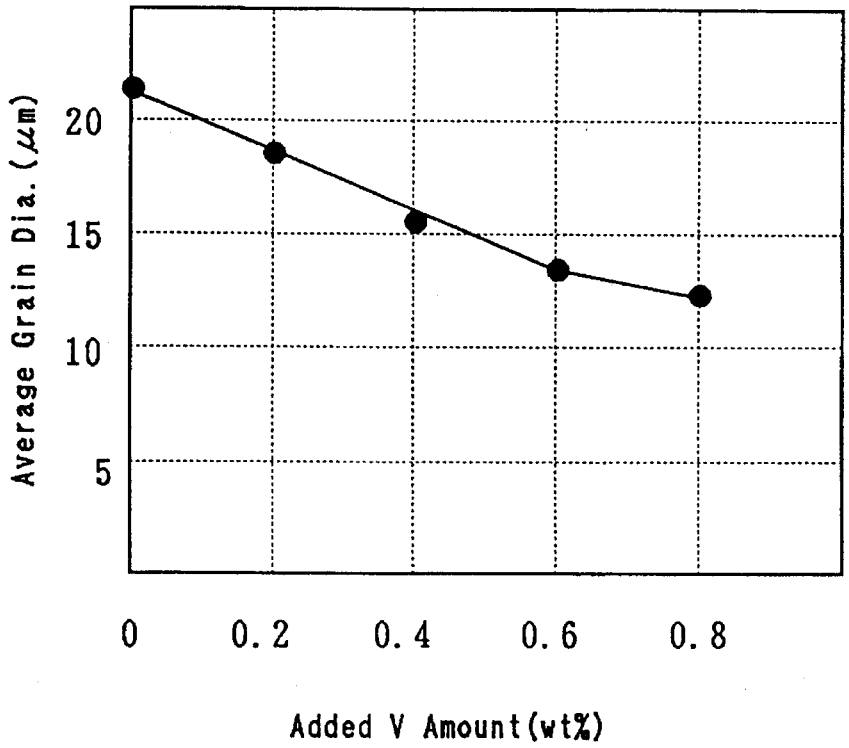
FIG. 19 is a graph showing the relation among average crystalline grain diameter, maximum energy product (BH)max and V content of a Nd-Fe-Co-B system sintered magnet.

Samples were measured for cold magnetic characteristic and average grain diameter, and results obtained are shown in FIG. 19. As shown in FIG. 19, inclusion of V can suppress the growth of crystal grain when sintering, so that the sintered body can have a small average grain diameter. This contributes to improvement of coercive force iHc. When V is contained in an amount exceeding 2.0 wt. %, the average grain diameter cannot be reduced very much, and maximum energy product (BH)max is lowered sharply. Therefore, V is added preferably in an amount of 0.1 to 2.0 wt. %.

EXAMPLE 11

Didym metal (70 wt. % of Nd and 30 wt. % of Pr) and metallic Dy, Fe, retro-B, ferro-Nb and metallic Ga were prepared in a certain weight and melted in a vacuum to produce a 10-kg ingot. This ingot had the following composition in weight %.

Composition:

$$(Nd+Pr)_{28.5}\text{-}Dy_{0.8}\text{-}B_{1.10}\text{-}Nb_x\text{-}Ga_{0.07}\text{ -}Al_{0.23}\text{-}Fe_{balance}$$

This ingot was processed in same ways as Example 1 to obtain fine powder having an average grain diameter of 4.0 micrometers (F.S.S.S.). In this step, a small volume of oxygen was mixed in the inert gas to obtain fine powder with variable oxygen contents. The fine powder was then press-molded and magnetized under same conditions as Example 1 to prepare a compact of 20×20×15 (mm).

The compact was sintered and heat-treated under same conditions as Example 1 so as to achieve a sintered body having a density of 7.55 to 7.58 g/cc and oxygen content of 2600 to 4500 ppm.

Figure 20:
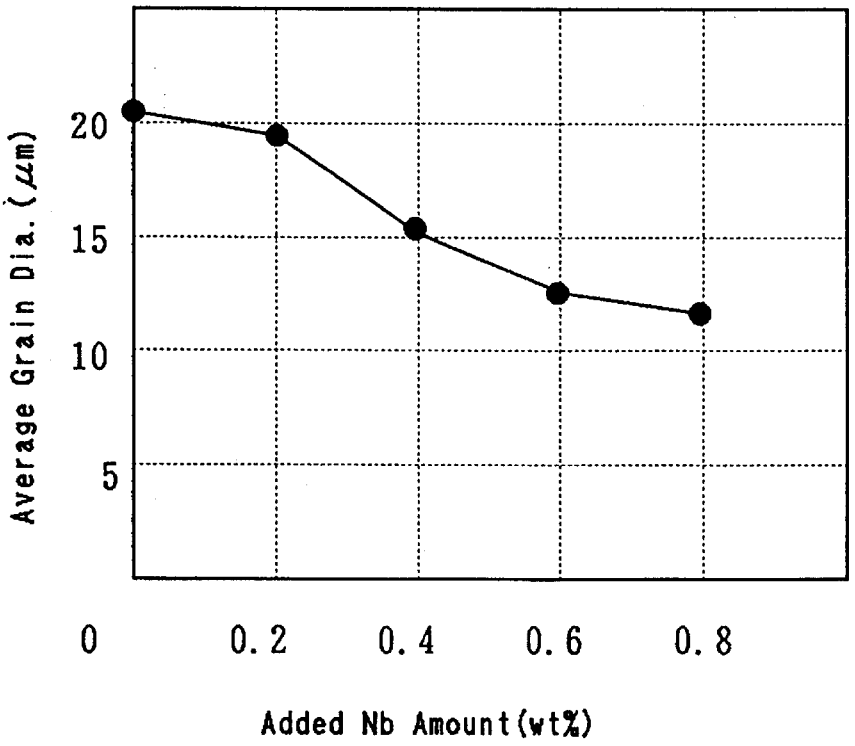
FIG. 20 is a graph showing the relation among average crystalline grain diameter, maximum energy product (BH)max and Nb content of a Nd-Fe-B system sintered magnet.

Samples were measured for cold magnetic characteristic and average grain diameter, and results obtained are shown in FIG. 20. As shown in FIG. 20, Inclusion of Nb can suppress the growth of crystal grain when sintering, so that the sintered body can have a small average grain diameter. This contributes to improvement of coercive force iHc. When Nb is contained in an amount exceeding 2.0 wt. %, the average grain diameter cannot be reduced very much, and maximum energy product (BH)max is lowered sharply. Therefore, Nb is added preferably in an amount of 0.1 to 2.0 wt. %.

EXAMPLE 12

Didym metal (70 wt. % of Nd and 30 wt. % of Pr) and metallic Dy, Fe, retro-B, ferro-V and metallic Ga were prepared in a certain weight and melted in a vacuum to produce a 10-kg ingot. This ingot had the following composition in weight %.

Composition:

$$(Nd+Pr)_{28.5}\text{-}Dy_{0.8}\text{-}B_{1.10}\text{-}V_x\text{-}Ga_{0.04}\text{ -}Al_{0.21}\text{-}Fe_{balance}$$

This ingot was processed in same ways as Example 1 to obtain fine powder having an average grain diameter of 4.0 micrometers (F.S.S.S.). In this step, a small volume of oxygen was mixed in the inert gas to obtain fine powder with variable oxygen contents. The fine powder was then press-molded and magnetized under same conditions as Example 1 to prepare a compact of 20×20×15 (mm).

The compact was sintered and heat-treated under same conditions as Example 1 so as to achieve a sintered body having a density of 7.55 to 7.58 g/cc and oxygen content of 2800 to 4400 ppm.

Figure 21:
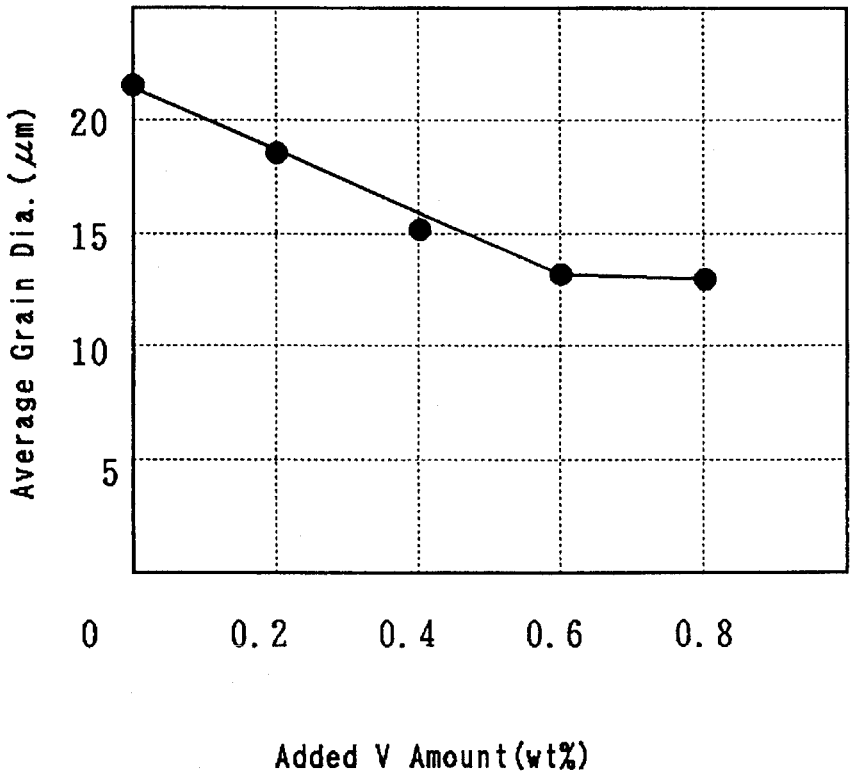
FIG. 21 is a graph showing the relation among average crystalline grain diameter, maximum energy product (BH)max and V content of a Nd-Fe-B system sintered magnet.

Samples were measured for cold magnetic characteristic and average grain diameter, and results obtained are shown in FIG. 21. As shown in FIG. 21, inclusion of V can suppress the growth of crystal grain when sintering, so that the sintered body can have a small average grain diameter. This contributes to improvement of coercive force iHc. When V is contained in an amount exceeding 2.0 wt. %, the average grain diameter cannot be reduced very much, and maximum energy product (BH)max is lowered sharply. Therefore, V is added preferably in an amount of 0.1 to 2.0 wt. %.

EXAMPLE 13

Metallic Nd, metallic Dy, Fe, Co, ferro-B, ferro-Nb and metallic Ga were prepared in a certain weight and melted in a vacuum to produce a 10-kg ingot. This ingot had the following composition in weight %.

Composition:

$Nd_{27.3}—Dy_{0.8}—B_{1.02}—Nb_{0.33}—Ga_{0.19}—Co_y—Al_z—Fe_{balance}$ (1) y = 0, z = 0
(2) y = 1.58, z = 0
(3) y = 1.60, z = 0.36 (wt. %)

Each ingot was processed in same ways as Example 1 to obtain fine powder having an average grain diameter of 3.8 micrometers (F.S.S.S.) and oxygen content of 4800 to 5500 ppm. The fine powder was then press-molded and magnetized under same conditions as Example 1 to prepare a compact of 30×20×15 (mm).

The compact was sintered at 1100° C. for two hours under a condition of substantially vacuum. The obtained sintered body was subjected to the primary heat treatment at 900° C. for two hours, then to the secondary heat treatment at 500° to 600° C. for two hours. The sintered body had a density of 7.56 to 7.59 g/cc and oxygen content of 2100 to 3300 ppm.

Figure 22:
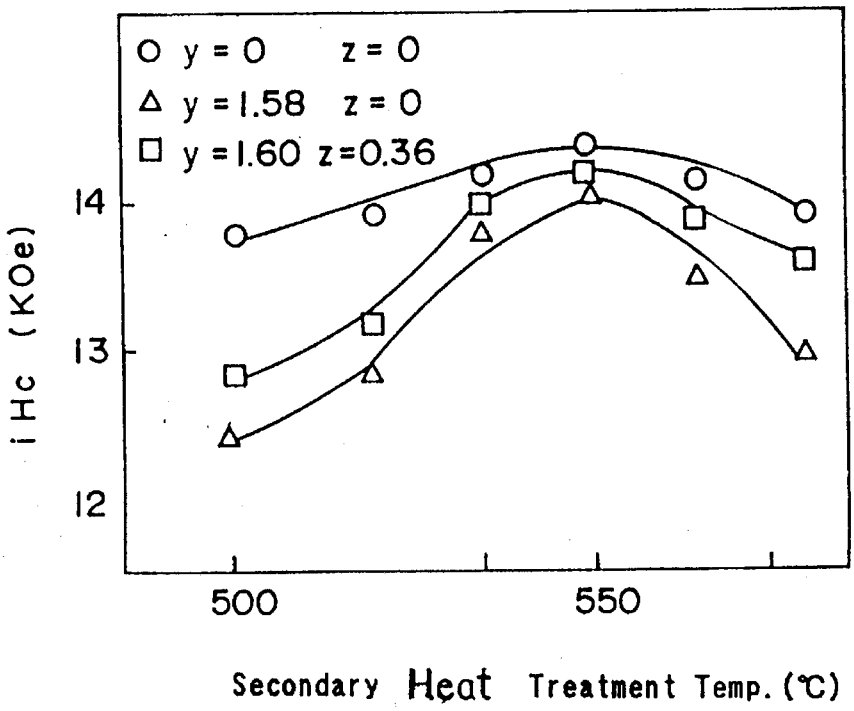
FIG. 22 is a graph showing the dependency of coercive force iHc of a Nd-Fe-Co-B system sintered magnet on the secondary heat-treating temperature due to the addition of Co and Al.

Samples were measured for cold magnetic characteristic, and results obtained are shown In FIG. 22. As shown in FIG. 22, the magnetic characteristic of a sample in which Co is independently added depends highly on the secondary heat treatment temperature as compared with a sample to which Co and Al are not added. In this case, a magnetic alloy with stable properties can not be produced. When Co and Al are added together, dependency on the secondary heat treatment temperature can be reduced as shown in FIG. 22, and the magnetic alloy with excellent properties can be produced.

Then, samples having the above compositions (1) (without Co added), (2) (with Co added) and (3) (with Co and Al added) were nickel-plated, and adhesion was evaluated.

For the nickel plating, an electrolytic plating was done in a watt bath, and a coating thickness was determined to be 10 micrometers. After plating, the samples are cleaned in water and dried at 100° C. for 5 minutes and then evaluated adhesion. Results are shown below. The Co-added material has superior adhesion of plating.

| Material | Adhesion strength (Kgf/cm$^2$) |
|---|---|
| (1) (without Co added) | 140 |
| (2) (with Co added) | 670 |

-continued

| Material | Adhesion strength (Kgf/cm$^2$) |
|---|---|
| (3) (with Co and Al added) | 680 |

EXAMPLE 14

Metallic Nd, metallic Dy, Fe, Co, ferro-B, ferro-V and metallic Ga were prepared in a certain weight and melted in a vacuum to produce a 10-kg ingot. This ingot had the following composition in weight %.

Composition:

$Nd_{27.5}—Dy_{0.8}—B_{1.00}—V_{0.34}—Ga_{0.20}—Co_y—Al_z—Fe_{balance}$ (1) y = 0, z = 0
(2) y = 1.57, z = 0
(3) y = 1.60, z = 0.35 (wt. %)

Each ingot was processed in same ways as Example 1 to obtain fine powder having an average grain diameter of 3.8 micrometers (F.S.S.S.) and oxygen content of 4200 to 5300 ppm. The fine powder was then press-molded and magnetized under same conditions as Example 1 to prepare a compact of 30×20×15 (mm).

The compact was sintered at 1100° C. for two hours under a condition of substantially vacuum. The obtained sintered body was press-molded to the primary heat treatment at 900° C. for two hours, then to the secondary heat treatment at 500° to 600° C. for two hours. The sintered body had a density of 7.56 to 7.59 g/cc and oxygen content of 2100 to 3300 ppm.

Figure 23:
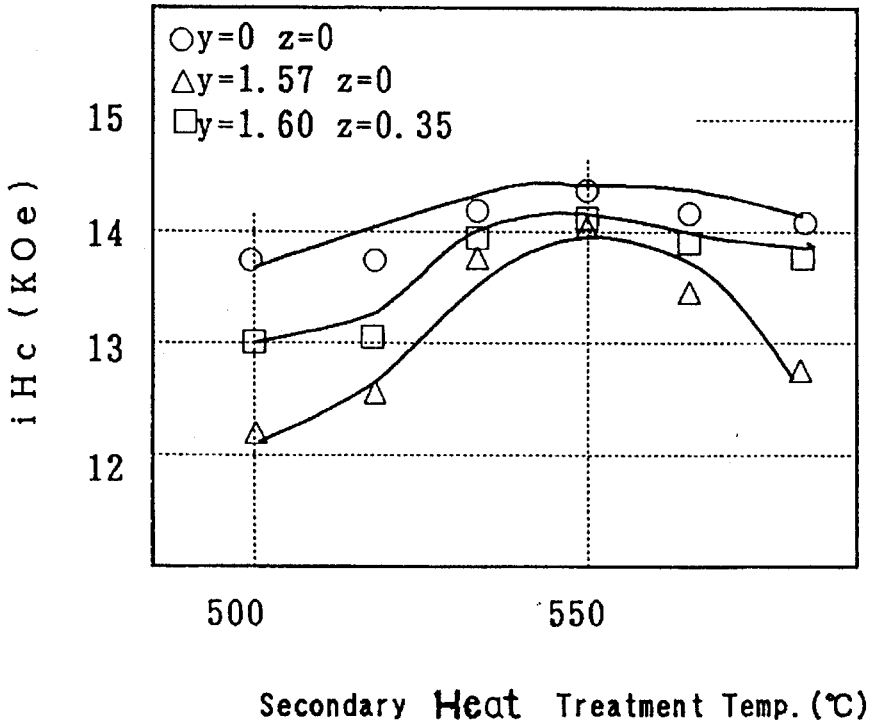
FIG. 23 is a graph showing the dependency of coercive force iHc of a Nd-Fe-B system sintered magnet on the secondary heat-treating temperature due to the addition of Co and Al.

Samples were measured for cold magnetic characteristic, and results obtained are shown in FIG. 23. As shown in FIG. 23, the magnetic characteristic of a sample in which Co is independently added depends highly on the secondary heat treatment temperature as compared with a sample to which Co and Al are not added. In such a case, a magnetic alloy with stable properties can not be produced. When Co and Al are added together, dependency on the secondary heat treatment temperature can be reduced as shown in FIG. 23, and the magnetic alloy with excellent properties can be produced.

Then, samples having the above compositions (1) (without Co added), (2) (with Co added) and (3) (with Co and Al added) were nickel-plated in same ways as Example 13, and adhesion was evaluated.

Results are as shown below, and it is seen that the Co-added material has superior adhesion of plating.

| Material | Adhesion strength (Kgf/cm$^2$) |
|---|---|
| (1) (without Co added) | 150 |
| (2) (with Co added) | 660 |
| (3) (with Co and Al added) | 685 |

EXAMPLE 15

Metallic Nd, metallic Dy, Fe, Co, ferro-B, ferro-Nb were prepared in a certain weight and metallic Ga in amounts shown in Table 1. They were melted in a vacuum to produce a 10-kg ingot. This ingot had the following composition in weight %.

Composition:

$Nd_{28.5}$-$Dy_{0.75}$-$B_{1.25}$-$Nb_{1.05}$-$Ga_c$-$Co_{0.15}$ -$Al_{0.30}$-$Fe_{balance}$ Each ingot was processed in same ways as Example 1 to obtain fine powder having an average grain diameter of 4.0 micrometers (F.S.S.S.) and oxygen content of 4500 ppm. The fine powder was then press-molded and magnetized under same conditions as Example 1 to prepare a compact of 20×20×15 (mm).

The compact was sintered at 1070° C. for three hours under a condition of substantially vacuum. The obtained sintered body was press-molded to the primary heat treatment at 930° C. for two hours, then to the secondary heat treatment at 520° C. for two hours. The resulting sintered body had a density of 7.54 to 7.57 g/cc and oxygen content of 1000 to 3400 ppm.

Samples were examined for the relation between Ga content in Nd phase and coercive force iHc. Results are shown in Table 1.

TABLE 1

| Amount of Ga added (wt %) | Ga content in Nd phase (wt. %) | iHc (Oe) |
|---|---|---|
| 0.05 | 0.18 | 13,800 |
| 0.1 | 0.30 | 14,500 |
| 0.2 | 0.45 | 15,200 |
| 0.3 | 0.71 | 14,500 |
| 0.4 | 0.93 | 14,000 |

The Ga contents in Nd phase were obtained by preparing samples by selectively melting Nd phase and analyzing by ICP (inductive coupling plasma emission spectral analysis) (the same is applied hereinafter).

Each samples has high coercive force exceeding 12 KOe satisfying the object of this invention.

EXAMPLE 16

Metallic Nd, metallic Dy, Fe, Co, retro-B, ferro-V were prepared in a certain weight and metallic Ga in amounts shown in Table 2. They were melted In a vacuum to produce a 10-kg ingot. This ingot had the following composition in weight %.

Composition:

$Nd_{28.5}$-$Dy_{0.80}$-$B_{1.20}$-$V_{1.05}$-$Ga_c$-$Co_{0.15}$ -$Al_{0.32}$-$Fe_{balance}$ Each ingot was processed in same ways as Example 1 to obtain fine powder having an average grain diameter of 4.0 micrometers (F.S.S.S.) and oxygen content of 4300 ppm. The fine powder was then press-molded and magnetized under same conditions as Example 1 to prepare a compact of 20×20×15 (mm).

The compact was sintered and heat-treated under same conditions as Example 15 so as to obtain a sintered body having a density of 7.54 to 7.57 g/cc and oxygen content of 1000 to 3200 ppm.

Samples were examined for the relation between Ga content in Nd phase and coercive force iHc. Results are shown in Table 2.

TABLE 2

| Amount of Ga added (wt %) | Ga content in Nd phase (wt. %) | iHc (Oe) |
|---|---|---|
| 0.05 | 0.19 | 13,600 |

TABLE 2-continued

| Amount of Ga added (wt %) | Ga content in Nd phase (wt. %) | iHc (Oe) |
|---|---|---|
| 0.1 | 0.29 | 14,400 |
| 0.2 | 0.43 | 15,300 |
| 0.3 | 0.72 | 14,400 |
| 0.4 | 0.95 | 14,100 |

Each samples has high coercive force exceeding 12 KOe satisfying the object of this Invention.

EXAMPLE 17

Metallic Nd, metallic Dy, Fe, ferro-B, ferro-Nb were prepared in a certain weight and metallic Ga in amounts shown in Table 3. They were melted in a vacuum to produce a 10-kg ingot. This ingot had the following composition in weight %.

Composition:

$Nd_{28.5}$-$Dy_{0.75}$-$B_{1.20}$-$Nb_{1.10}$-$Ga_c$ -$Al_{0.16}$-$Fe_{balance}$ Each ingot was processed in same ways as Example 1 to obtain fine powder having an average grain diameter of 4.0 micrometers (F.S.S.S.) and oxygen content of 4400 ppm. The fine powder was then press-molded and magnetized under same conditions as Example 1 to prepare a compact of 20×20×15 (mm).

The compact was sintered and heat-treated under same conditions as Example 15 so as to obtain a sintered body having a density of 7.54 to 7.57 g/cc and oxygen content of 1000 to 3500 ppm.

Samples were examined for the relation between Ga content in Nd phase and coercive force iHc. Results are shown in Table 3.

TABLE 3

| Amount of Ga added (wt %) | Ga content in Nd phase (wt. %) | iHc (Oe) |
|---|---|---|
| 0.05 | 0.20 | 13,800 |
| 0.1 | 0.30 | 14,600 |
| 0.2 | 0.46 | 15,500 |
| 0.3 | 0.73 | 14,600 |
| 0.4 | 0.94 | 14,000 |

Each samples has high coercive force exceeding 12 KOe satisfying the object of this invention.

EXAMPLE 18

Metallic Nd, metallic Dy, Fe, ferro-B, ferro-V were prepared in a certain weight and metallic Ga in amounts shown in Table 4. They were melted in a vacuum to produce a 10-kg ingot. This ingot had the following composition in weight %.

Composition:

$Nd_{28.5}$-$Dy_{0.65}$-$B_{1.25}$-$V_{1.10}$-$Ga_c$ -$Al_{0.19}$-$Fe_{balance}$ Each Ingot was processed in same ways as Example 1 to obtain fine powder having an average grain diameter of 4.0 micrometers (F.S.S.S.) and oxygen content of 4350 ppm. The fine powder was then press-molded and magnetized under same conditions as Example 1 to prepare a compact of 20×20×15 (mm).

The compact was sintered and heat-treated under same conditions as Example 15 so as to obtain a sintered body having a density of 7.54 to 7.57 g/cc and oxygen content of 1000 to 3500 ppm.

Samples were examined for the relation between Ga content in Nd phase and coercive force iHc. Results are shown In Table 4.

TABLE 4

| Amount of Ga added (wt %) | Ga content in Nd phase (wt. %) | iHc (Oe) |
|---|---|---|
| 0.05 | 0.18 | 13,700 |
| 0.1 | 0.31 | 14,500 |
| 0.2 | 0.44 | 15,300 |
| 0.3 | 0.75 | 14,700 |
| 0.4 | 0.95 | 14,100 |

Each samples has high coercive force exceeding 12 KOe satisfying the object of this invention.

EXAMPLE 19

Metallic Nd, metallic Dy, Fe, Co, ferro-B, ferro-Nb and metallic Ga were prepared in a certain weight and were melted in a vacuum to produce a 10-kg ingot. This ingot had the following composition in weight %.

Composition:

$$Nd_{28.0}\text{-}Dy_{1.0}\text{-}B_{1.05}\text{-}Nb_{0.65}\text{-}Ga_{0.1}\text{-}Co_{0.20}\text{-}Al_{0.35}\text{-}Fe_{balance}$$

The ingot was processed In same ways as Example 1 to obtain fine powder having an average grain diameter of 4.0 micrometers (F.S.S.S.) and oxygen content of 4800 ppm. The fine powder was then press-molded and magnetized under same conditions as Example 1 to prepare a compact of 20×20×15 (mm).

The compact was sintered and heat-treated under same conditions as Example 1 so as to obtain a sintered body having a density of 7.55 to 7.58 g/cc and oxygen content of 1000 to 3500 ppm.

Samples were examined for the relation among Ga content in Nd phase, coercive force iHc and Hk. Results are shown in Table 5. When the Ga content in Nd phase is less than 1.8 times of the added amount of Ga, coercive force iHc remains at 11.8 KOe.

TABLE 5

| Ga content in Nd phase (wt. %) | iHc (Oe) | Hk(Oe) | |
|---|---|---|---|
| 0.03 | 8,500 | 7,400 | Comparative ex. |
| 0.18 | 11,800 | 9,200 | Comparative ex. |
| 0.25 | 13,800 | 12,970 | Example |
| 0.34 | 14,400 | 14,100 | Example |
| 0.35 | 14,800 | 14,500 | Example |

EXAMPLE 20

Metallic Nd, metallic Dy, Fe, Co, ferro-B, ferro-V and metallic Ga were prepared in a certain weight and were melted in a vacuum to produce a 10-kg Ingot. This ingot had the following composition in weight %.

Composition:

$$Nd_{28.0}\text{-}Dy_{1.0}\text{-}B_{1.03}\text{-}V_{0.67}\text{-}Ga_{0.1}\text{-}Co_{0.21}\text{-}Al_{0.35}\text{-}Fe_{balance}$$

The Ingot was processed in same ways as Example 1 to obtain fine powder having an average grain diameter of 4.0 micrometers (F.S.S.S.) and oxygen content of 4800 ppm. The fine powder was then press-molded and magnetized under same conditions as Example 1 to prepare a compact of 20×20×15 (mm).

The compact was sintered and heat-treated under same conditions as Example 1 so as to obtain a sintered body having a density of 7.55 to 7.58 g/cc and oxygen content of 1000 to 3600 ppm.

Samples were examined for the relation among Ga content in Nd phase, coercive force iHc and Hk. Results are shown in Table 6. When the Ga content in Nd phase is less than 1.7 times of the added amount of Ga, coercive force iHc remains at 11.7 KOe.

TABLE 6

| Ga content in Nd phase (wt. %) | iHc (Oe) | Hk(Oe) | |
|---|---|---|---|
| 0.04 | 8,300 | 7,200 | Comparative ex. |
| 0.17 | 11,700 | 9,100 | Comparative ex. |
| 0.27 | 13,900 | 12,960 | Example |
| 0.35 | 14,500 | 14,000 | Example |
| 0.36 | 14,900 | 14,600 | Example |

EXAMPLE 21

Metallic Nd, metallic Dy, Fe, ferro-B, ferro-Nb and metallic Ga were prepared in a certain weight and were melted in a vacuum to produce a 10-kg ingot. This ingot had the following composition in weight %.

Composition:

$$Nd_{28.0}\text{-}Dy_{1.0}\text{-}B1.10\text{-}Nb_{0.65}\text{-}Ga_{0.1}\text{-}Al_{0.24}\text{-}Fe_{balance}$$

The ingot was processed in same ways as Example 1 to obtain fine powder having an average grain diameter of 4.0 micrometers (F.S.S.S.) and oxygen content of 4700 ppm. The fine powder was then press-molded and magnetized under same conditions as Example 1 to prepare a compact of 20×20×15 (mm).

The compact was sintered and heat-treated under same conditions as Example 1 so as to obtain a sintered body having a density of 7.55 to 7.58 g/cc and oxygen content of 1000 to 3700 ppm.

Samples were examined for the relation among Ga content in Nd phase, coercive force iHc and Hk. Results are shown in Table 7. When the Ga content in Nd phase is less than 1.8 times of the added amount of Ga, coercive force iHc remains at 11.6 KOe.

TABLE 7

| Ga content in Nd phase (wt. %) | iHc (Oe) | Hk(Oe) | |
|---|---|---|---|
| 0.03 | 8,600 | 7,350 | Comparative ex. |
| 0.18 | 11,600 | 9,300 | Comparative ex. |
| 0.25 | 13,900 | 12,900 | Example |
| 0.33 | 14,300 | 14,000 | Example |
| 0.37 | 15,000 | 14,700 | Example |

EXAMPLE 22

Metallic Nd, metallic Dy, Fe, ferro-B, ferro-V and metallic Ga were prepared in a certain weight and were melted in a vacuum to produce a 10-kg ingot. This ingot had the following composition in weight %.

Composition:

$$Nd_{28.0}\text{-}Dy_{1.0}\text{-}B_{1.05}\text{-}V_{0.70}\text{-}Ga_{0.1}\text{-}Al_{0.22}\text{-}Fe_{balance}$$

The ingot was processed in same ways as Example 1 to obtain fine powder having an average grain diameter of 4.0 micrometers (F.S.S.S.) and oxygen content of 4750 ppm. The fine powder was then press-molded and magnetized under same conditions as Example 1 to prepare a compact of 20×20×15 (mm).

The compact was sintered and heat-treated under same conditions as Example 1 so as to obtain a sintered body having a density of 7.55 to 7.58 g/cc and oxygen content of 1000 to 3800 ppm.

Samples were examined for the relation among Ga content in Nd phase, coercive force iHc and Hk. Results are shown in Table 8. When the Ga content in Nd phase is less than 1.7 times of the added amount of Ga, coercive force iHc remains at 11.5 KOe.

TABLE 8

| Ga content in Nd phase (wt. %) | iHc (Oe) | Hk(Oe) | |
|---|---|---|---|
| 0.05 | 8,500 | 7,200 | Comparative ex. |
| 0.17 | 11,500 | 9,250 | Comparative ex. |
| 0.23 | 13,500 | 12,940 | Example |
| 0.35 | 14,600 | 14,200 | Example |
| 0.37 | 15,000 | 14,700 | Example |

EXAMPLE 23

Metallic Nd, metallic Dy, Fe, Co, ferro-B, ferro-Nb and metallic Ga were prepared In a certain weight and were melted in a vacuum to produce a 10-kg ingot. This ingot had the following composition in weight %.

Composition:

$$Nd_{27.5}\text{-}Dy_{2.0}\text{-}B_{1.1-1.4}\text{-}Nb_{1.5}\text{-}Ga_{0.07}\text{-}Co_{0.25}\text{-}Al_{0.30}\text{-}Fe_{balance}$$

The ingot was processed in same ways as Example 1 to obtain fine powder having an average grain diameter of 4.0 micrometers (F.S.S.S.) and oxygen content of 4800 ppm. The fine powder was then press-molded and magnetized under same conditions as Example 1 to prepare a compact of 20×20×15 (mm).

The compact was sintered and heat-treated under same conditions as Example 1 so as to obtain a sintered body having a density of 7.55 to 7.58 g/cc and oxygen content of 1000 to 3700 ppm.

Samples were examined for the relation among volume % of B rich phase, residual magnetic flux density Br and maximum energy product (BH)max. Results are shown in Table 9. As the B rich phase increases, residual magnetic flux density Br and maximum energy product (BH)max are reduced, and when the B rich phase reaches 2.5 vol. %, maximum energy product (BH)max lowers to below 42 MGOe.

TABLE 9

| B rich phase (vol. %) | Br(MGOe) | (BH)max(MGOe) | |
|---|---|---|---|
| 1.0 | 14,000 | 47 | 1.1 wt. % of B added |
| 1.5 | 13,800 | 45 | 1.2 wt. % of B added |
| 2.0 | 13,500 | 44 | 1.3 wt. % of B added |
| 2.5 | 13,200 | 41.6 | 1.4 wt. % of B added |

EXAMPLE 24

Metallic Nd, metallic Dy, Fe, Co, ferro-B, ferro-V and metallic Ga were prepared in a certain weight and were melted in a vacuum to produce a 10-kg ingot. This ingot had the following composition in weight %.

Composition:

$$Nd_{27.5}\text{-}Dy_{2.0}\text{-}B_{1.1-1.4}\text{-}V_{1.6}\text{-}Ga_{0.08}\text{-}Co_{0.22}\text{-}Al_{0.30}\text{-}Fe_{balance}$$

The ingot was processed in same ways as Example 1 to obtain fine powder having an average grain diameter of 4.0 micrometers (F.S.S.S.) and oxygen content of 4800 ppm. The fine powder was then press-molded and magnetized under same conditions as Example 1 to prepare a compact of 20×20×15 (mm).

The compact was sintered and heat-treated under same conditions as Example 1 so as to obtain a sintered body having a density of 7.55 to 7.58 g/cc and oxygen content of 1000 to 3600 ppm.

Samples were examined for the relation among volume % of B rich phase, residual magnetic flux density Br and maximum energy product (BH)max. Results are shown in Table 10. As the B rich phase increases, residual magnetic flux density Br and maximum energy product (BH)max are reduced, and when the B rich phase reaches 2.4 vol. %, maximum energy product (BH)max lowers to below 42 MGOe.

TABLE 10

| B rich phase (vol. %) | Br(MGOe) | (BH)max(MGOe) | |
|---|---|---|---|
| 1.1 | 14,100 | 47.5 | 1.1 wt. % of B added |
| 1.6 | 13,700 | 46 | 1.2 wt. % of B added |
| 1.9 | 13,400 | 44 | 1.3 wt. % of B added |
| 2.4 | 13,100 | 41.4 | 1.4 wt. % of B added |

EXAMPLE 25

Metallic Nd, metallic Dy, Fe, ferro-B, ferro-Nb and metallic Ga were prepared in a certain weight and were melted in a vacuum to produce a 10-kg ingot. This ingot had the following composition in weight %.

Comosition:

$$Nd_{27.5}\text{-}Dy_{1.9}\text{-}B_{1.1-1.4}\text{-}Nb_{1.5}\text{-}Ga_{0.06}\text{-}Al_{0.15}\text{-}Fe_{balance}$$

The ingot was processed In same ways as Example 1 to obtain fine powder having an average grain diameter of 4.0 micrometers (F.S.S.S.) and oxygen content of 4800 ppm. The fine powder was then press-molded and magnetized under same conditions as Example 1 to prepare a compact of 20×20×15 (mm).

The compact was sintered and heat-treated under same conditions as Example 1 so as to obtain a sintered body having a density of 7.55 to 7.58 g/cc and oxygen content of 1000 to 3700 ppm.

Samples were examined for the relation among volume % of B rich phase, residual magnetic flux density Br and maximum energy product (BH)max. Results are shown in Table 11. As the B rich phase increases, residual magnetic flux density Br and maximum energy product (BH)max are reduced, and when the B rich phase reaches 2.5 vol. %, maximum energy product (BH)max lowers to below 42 MGOe.

TABLE 11

| B rich phase (vol. %) | Br(MGOe) | (BH)max(MGOe) | |
|---|---|---|---|
| 1.1 | 14,000 | 47 | 1.1 wt. % of B added |
| 1.5 | 13,900 | 45.5 | 1.2 wt. % of B added |
| 2.1 | 13,400 | 44 | 1.3 wt. % of B added |
| 2.5 | 13,200 | 41.5 | 1.4 wt. % of B added |

EXAMPLE 26

Metallic Nd, metallic Dy, Fe, ferro-B, ferro-V and metallic Ga were prepared in a certain weight and were melted in a vacuum to produce a 10-kg ingot. This ingot had the following composition in weight %.

Comosition:

$$Nd_{27.5}\text{-}Dy_{2.0}\text{-}B_{1.1\text{-}1.4}\text{-}V_{1.6}\text{-}Ga_{0.09}\text{-}Al_{0.19}\text{-}Fe_{balance}$$

The ingot was processed in same ways as Example 1 to obtain fine powder having an average grain diameter of 4.0 micrometers (F.S.S.S.) and oxygen content of 4800 ppm. The fine powder was then press-molded and magnetized under same conditions as Example 1 to prepare a compact of 20×20×15 (mm).

The compact was sintered and heat-treated under same conditions as Example 1 so as to obtain a sintered body having a density of 7.55 to 7.58 g/cc and oxygen content of 1000 to 3400 ppm.

Samples were examined for the relation among volume % of B rich phase, residual magnetic flux density Br and maximum energy product (BH)max. Results are shown in Table 12. As the B rich phase increases, residual magnetic flux density Br and maximum energy product (BH)max are reduced, and when the B rich phase reaches 2.5 vol. %, maximum energy product (BH)max lowers to below 42 MGOe.

TABLE 12

| B rich phase (vol. %) | Br(MGOe) | (BH)max(MGOe) | |
|---|---|---|---|
| 1.0 | 14,100 | 47.3 | 1.1 wt. % of B added |
| 1.5 | 13,700 | 45.1 | 1.2 wt. % of B added |
| 2.0 | 13,500 | 43.9 | 1.3 wt. % of B added |
| 2.5 | 13,400 | 41.5 | 1.4 wt. % of B added |

As described above, by optimizing the composition and producing condition, this invention provides Nd-Fe-B system magnets having high maximum energy product (BH)max of 42 MGOe or more and coercive force (iHc) of 12 KOe or more.

What is claimed is:

1. A Nd-Fe-B permanent magnet comprising 28 to 32 wt. % of Nd and Dy, wherein Dy ranges from 0.4 to 3 wt. %, 6 wt. % or less of Co, 0.5 wt. % or less of Al, 0.9 to 1.3 wt. % of B, at least one of 0.05 to 2.0 wt. % of Nb and 0.05 to 2.0 wt. % of V, 0.02 to 0.5 wt. % of Ga, and Fe, and having a coercive force iHc of 12 KOe or more and a maximum energy product (BH)max of 42 MGOe or more, and wherein the Ga content in an Nd phase is two times or more of the added amount of Ga in the entire magnet.

2. The Nd-Fe-B permanent magnet according to claim 1, wherein Ga content is 0.03 to 0.2 wt. %.

3. The Nd-Fe-B permanent magnet according to claim 1, wherein Ga content is 0.05 to 0.15 wt. %.

4. The Nd-Fe-B permanent magnet according to claim 1, wherein Dy content is 0.7 to 1.5 wt. %, B is 0.95 to 1.1 wt. %, Nb is 0.1 to 1.0 wt. % and V is 0.1 to 1.0 wt. %.

5. The Nd-Fe-B permanent magnet according to claim 1, wherein B rich phase is 2 vol. % or below.

6. The Nd-Fe-B permanent magnet according to claim 1, wherein Nd is partly substituted by Pr.

7. The Nd-Fe-B permanent magnet according to claim 1, wherein oxygen content is 500 ppm to 5000 ppm.

8. The Nd-Fe-B permanent magnet according to claim 1, wherein surface of the magnet is electrolytically plated with nickel.

9. A Nd-Fe-B permanent magnet comprising 28 to 32 wt. % of Nd and Dy, wherein Dy ranges from 0.4 to 3 wt. %, 0.3 wt. % or less of Al, 0.9 to 1.3 wt. % of B, at least one of 0.05 to 2.0 wt. % of Nb and 0.05 to 2.0 wt. % of V, 0.02 to 0.5 wt. % of Ga, and Fe, and having a coercive force of 12 KOe or more and a maximum energy product (BH)max of 42 MGOe or more, and wherein the Ga content in an Nd phase is two times or more of the added amount of Ga in the entire magnet.

10. The Nd-Fe-B permanent magnet according to claim 9, wherein Ga content is 0.03 to 0.2 wt. %.

11. The Nd-Fe-B permanent magnet according to claim 9, wherein Ga content is 0.05 to 0.15 wt. %.

12. The Nd-Fe-B permanent magnet according to claim 9, wherein Dy content is 0.7 to 1.5 wt. %, B is 0.95 to 1.1 wt. %, Nb is 0.1 to 1.0 wt. % and V is 0.1 to 1.0 wt. %.

13. The Nd-Fe-B permanent magnet according to claim 9, wherein B rich phase is 2 vol. % or below.

14. The Nd-Fe-B permanent magnet according to claim 9, wherein Nd is partly substituted by Pr.

15. The Nd-Fe-B permanent magnet according to claim 9, wherein oxygen content is 500 ppm to 5000 ppm.

* * * * *